United States Patent [19]

Lopez et al.

[11] Patent Number: 4,557,821

[45] Date of Patent: Dec. 10, 1985

[54] HEAVY OIL HYDROPROCESSING

[75] Inventors: Jaime Lopez; Joel D. McKinney; Eugene A. Pasek, all of Pittsburgh, Pa.

[73] Assignee: Gulf Research & Development Company, Pittsburgh, Pa.

[21] Appl. No.: 527,414

[22] Filed: Aug. 29, 1983

[51] Int. Cl.[4] ..... C10G 45/04; C10G 45/46; C10G 45/60; C10G 47/06

[52] U.S. Cl. ..... 208/108; 208/143; 208/216 R; 208/251 H; 502/220

[58] Field of Search ..... 208/107, 108, 111, 112, 208/216 R, 251 H, 254 H, 143; 502/220

[56] References Cited

U.S. PATENT DOCUMENTS

| | | | |
|---|---|---|---|
| 2,686,763 | 8/1954 | Johnson et al. | 502/26 |
| 3,458,433 | 7/1969 | Wood et al. | 208/89 |
| 3,471,398 | 10/1969 | Borst, Jr. | 208/111 |
| 3,619,410 | 11/1971 | Gleim | 208/108 |
| 3,622,497 | 11/1971 | Gleim | 208/108 |
| 3,622,499 | 11/1971 | Stine et al. | 208/108 |
| 3,663,431 | 5/1972 | Wagner et al. | 208/143 |
| 3,876,755 | 4/1975 | Kurtak et al. | 423/517 |
| 4,172,814 | 10/1979 | Moll et al. | 208/108 |
| 4,243,554 | 1/1981 | Naumann et al. | 502/220 |

OTHER PUBLICATIONS

Prasad et al., "Thermal Decomposition of $(NH_4)_2MoO_2S_2$ . . . ", J. Inorg. Chem., 1973, 35, pp. 1895–1904.

*Primary Examiner*—Delbert E. Gantz
*Assistant Examiner*—O. Chaudhuri
*Attorney, Agent, or Firm*—Deane E. Keith; Forrest D. Stine

[57] ABSTRACT

Heavy or refractory oils are hydroprocessed in the presence of added water and added hydrogen sulfide with or without a slurry catalyst comprising molybdenum sulfide. The water and hydrogen sulfide may originate from the catalyst preparation procedure.

37 Claims, 19 Drawing Figures

% OF PARTICLES
60
50
40
30
20
10
0
Final Catalyst (100% Mo)
Displaced Precursor Solids
Precursor Solids (12% Mo)
0
20
40
60
80
100
120
140
160
PARTICLE DIAMETER: MICRONS PRECURSOR SOLIDS, AVG. PARTICLE SIZE: MICRONS
20
15
10
5
0
0.0
0.1
0.2
0.3
0.4
0.5
0.6
0.7
AMMONIA / MOLYBDENUM: WT. RATIO COKE YIELD: WT.%
25
20
15
10
5
0
$H_2S$ Partial Pressure=
182 PSI (Constant)
0
10
20
30
40
50
60
70
80
90
100
110
120
CIRCULATION RATE, HYDROGEN SULFIDE / MOLYBDENUM: SCF/LB.

DELTA API GRAVITY
10.0
7.5
5.0
2.5
0
400
450
500
550
600
650
700
750
800
850
PRETREATER TEMPERATURE: °F

HEAVY OIL HYDROPROCESSING

This invention relates to the catalytic or non-catalytic hydroprocessing of heavy hydrocarbon oils including crude oils, heavy crude oils, residual oils and refractory heavy distillates, including FCC decanted oils and lubricating oils. It also relates to the hydroprocessing of shale oils, oils from tar sands, and coal liquids. Shale oil feedstocks need not be first deashed or dearsenated since the catalyst of this invention can remove 96 percent or more of the nitrogen in shale oil in the presence of the ash and arsenic content of the shale oil.

The present process is a hydrogenation process, and in the mode employing a solid catalyst the catalyst is a hydrogenation catalyst. The catalyst is not a hydrocracking catalyst because it does not have a cracking component, such as an acidic support. In general, hydrocracking catalysts are supported upon a porous acidic material which constitutes the hydrocracking component, e.g. silica or silica-alumina. In contrast, the active metal of the present catalyst is not supported. Injected hydrogen sulfide circulating through the system is the only significant acidic process component and hydrogen sulfide has only mild acidity. Therefore, in the present system, any reduction in molecular weight occurs primarily via thermal cracking rather than through catalytic hydrocracking. For this reason the hydrocarbon reactor temperature is sufficiently elevated to be in the thermal cracking range when cracking is desired, and the temperature is below the thermal cracking range when hydrogenation without cracking is desired. Of course, catalytic hydrocracking activity can be imparted to the present process, if desired, by adding cracking components such as zeolites or silica-alumina particles which are small enough to be slurried and are of about the same size as the catalyst particles of this invention.

The catalytic mode of this invention employs a circulating slurry catalyst. The circulating nature of the slurry catalyst of this invention is conducive to the employment of elevated process temperatures. In contrast, elevated temperatures would be impractical in a fixed bed system. The employment of high process temperatures in conjunction with a fixed bed catalyst induces progressive coke accumulation on the catalyst leading to a catalyst aging problem. In contrast, with a slurry catalyst, catalyst rejuvenation can be very rapid since fresh catalyst is continuously introduced to the system while used catalyst is continuously removed from the system so that there is no catalyst aging problem.

Therefore, fixed bed catalysts are temperature limited due to the formation of coke which deposits on the outer surface of the catalyst and plugs catalyst pores, destroying catalyst activity. However, the present slurry catalyst exists as a substantially homogeneous dispersion in oil of small particles made up of very small crystallites so that its activity is more dependent on the smallness of its particle size than on its pore characteristics. Although the present catalyst does have pores and there is some reactant migration into pores, most of the activity probably is exerted at the exterior of the catalyst because of the absence of a porous support.

The catalyst of the present invention comprises dispersed particles of a highly active form of molybdenum disulfide. To prepare the catalyst an aqueous slurry of molybdenum oxide ($MoO_3$) is reacted with aqueous ammonia and then with hydrogen sulfide in a low pressure, low temperature zone, to produce suspended insoluble ammonium oxy-sulfide compound in equilibrium with ammonium molybdenum heptamolybdate in solution. The aqueous equilibrium slurry leaving the low pressure, low temperature zone constitutes a catalyst precursor, and these compounds are subsequently converted into a highly active sulfide of molybdenum, which is essentially ammonia-free and is the final catalyst, by reaction with hydrogen sulfide and hydrogen, in at least two high pressure, high temperature zones in the presence of the feed oil but in advance of the hydroprocessing reactor. The final catalyst has a sulfur to molybdenum atomic ratio of about two but is much more active than molybdenum disulfide catalysts of the prior art. The ammonium molybdenum oxy-sulfide/-heptamolybdate catalyst precursor is an aqueous mixture of stable compounds in three states including the slurry state (particle diameter 0.2 microns or greater), the colloidal state (particle diameter less than 0.2 microns) and the solution phase. Laboratory filters commonly remove particles of 0.2 microns in diameter, or larger. Non-filterable particles in solution smaller than 0.2 microns are considered colloids herein.

X-ray diffraction analysis of the final catalyst prepared in accordance with this invention shows that it essentially comprises crystallites of $MoS_2$. There appears to be some oxygen in the final catalyst. This oxygen may be in the $MoS_2$ lattice or it may be adsorbed in the crystallites from oxygen-containing organic molecules in the surrounding oil medium.

Although the final catalyst comprises crystallites of $MoS_2$, we have found it to be an exceptionally active form of $MoS_2$ and is more active catalytically than $MoS_2$ of the prior art. It appears that the activity of the final catalyst depends upon the conditions employed during its preparation. Certain preparation conditions affecting the activity of the final catalyst include the $NH_3/Mo$ ratio and the $H_2S/Mo$ ratio used in preparing the precursor, the temperatures, time duration and number of stages used in converting the precursor to the $MoS_2$ final catalyst, the presence of hydrogen and hydrogen sulfide during the conversion of the precursor to $MoS_2$ and the use of an oil medium during the conversion of the precursor to $MoS_2$.

The variation in the conditions of catalyst preparation can have a great effect because of the complexity of molybdenum chemistry. The literature shows that a large variety of mononuclear to polynuclear molybdenum complexes exist in various Mo and hydrogen ion concentrations including $H_2MoO_4$, $HMoO_4^-$, $MoO_4^{2-}$, $Mo_7O_{24}^{6-}$, $Mo_7O_{23}(OH)^{5-}$, $Mo_7O_{22}(OH)_2^{4-}$, $Mo_7O_2(OH)^{3-}$ and $Mo_{19}O_{59}^{4-}$. The addition of $H_2S$ to an acidic solution containing Mo results in a product known as molybdenum blue, of which the exact composition and structure is unknown, except that it is a Mo(V)-Mo(VI)-oxide-hydroxide complex. The addition of $H_2S$ at high pH results in various mononuclear molybdenum-sulfur complexes including $MoO_3S^{2-}$, $MoO_2S_2^{2-}$, $MoOS_3^{2-}$, and $MoS_4^{2-}$. All of these complexes are known from the literature.

When preparing the precursor for the catalyst of the present invention by dissolving $MoO_3$ in aqueous ammonia and then injecting $H_2S$, in one preparation about 12 weight percent of the dissolved molybdenum separates as reddish orange-brown solid particles. The filtrate separated from these solids, upon evaporation to dryness, was found by X-ray diffraction to be crystalline and essentially comprise ammonium heptamolybdate, $(NH_4)_6Mo_7O_{24}.4H_2O$. The reddish-orange-brown solids were found to contain Mo, N, H, O and S and have no crystallinity as measured by X-ray diffraction. When the filtrate is allowed to stand, solids form which are secondary ammonium molybdenum oxysulfides. Particular oxysulfides are formed under particular preparation conditions so that a wide variety of complexes can be formed depending on the $NH_3$/Mo weight ratio and the amount of $H_2S$ added in preparing the precursor. The following complexes fit the analytical data and illustrate the wide variety of secondary complexes unknown in the literature that may be formed from the filtrate by varying these reactants.

| $NH_3$/Mo (weight ratio) | $H_2S$/Mo (SCF/lb) | Possible Complex |
|---|---|---|
| 0.16 | 1 | $(NH_4)_6Mo_7O_{20}S_4$ |
| 0.16 | 3 | $(NH_4)_5Mo_7O_{16}(OH)S_7$ |
| 0.16 | 5 | $(NH_4)_5Mo_7O_9(OH)S_{14}$ |
| 0.16 | 8 | $(NH_4)_6Mo_7O_7S_{17}$ |
| 0.23 | 1 | $(NH_4)_6Mo_7O_{14}S_{10}$ |
| 0.23 | 3 | $(NH_4)_5Mo_7O_{13}S_{10}$ |
| 0.23 | 5 | $(NH_4)_5Mo_7O_9(OH)S_{13}$ |
| 0.23 | 8 | $(NH_4)_6Mo_7O_{11}S_{13}$ |
| 0.23 | 16 | $(NH_4)_6Mo_7O_4S_{20}$ |

For solutions having $NH_3$/Mo weight ratios significantly larger than 0.23, data indicate the molybdenum framework of the secondary solids is smaller than the heptamolybdate and may be even the monomolybdate. Apparently, the excess ammonia causes the heptamolybdate to break down and eventually reach the mono-molybdenum state.

The above shows the wide variety of possible materials that can be produced in preparing the catalyst precursor. The various precursors result in final catalysts of differing activity. The reason for the high activity of the $MoS_2$ final catalyst of this invention is not known. It may be due to the small crystallite size of the $MoS_2$, the manner in which the crystallites stack, the diffusional access to active sites, the size of the particles, or to other reasons.

This invention is described below and in conjunction with the attached figures in which:

FIGS. 1, 2, 3 and 4 relate to particle size of the precursor and final catalysts;

FIG. 5 relates to solids concentration in the precursor slurry;

FIGS. 6 and 7 relate catalyst hydrogenation activity to catalyst preparation procedure;

FIGS. 8, 9 and 10 relate the sulfur and oxygen content associated with the catalyst to catalyst preparation;

FIG. 11 relates process $H_2S$ circulation rate to coking tendency;

FIGS. 12 and 13 relate catalyst sulfiding temperature to product delta API gravity;

Figure 1:
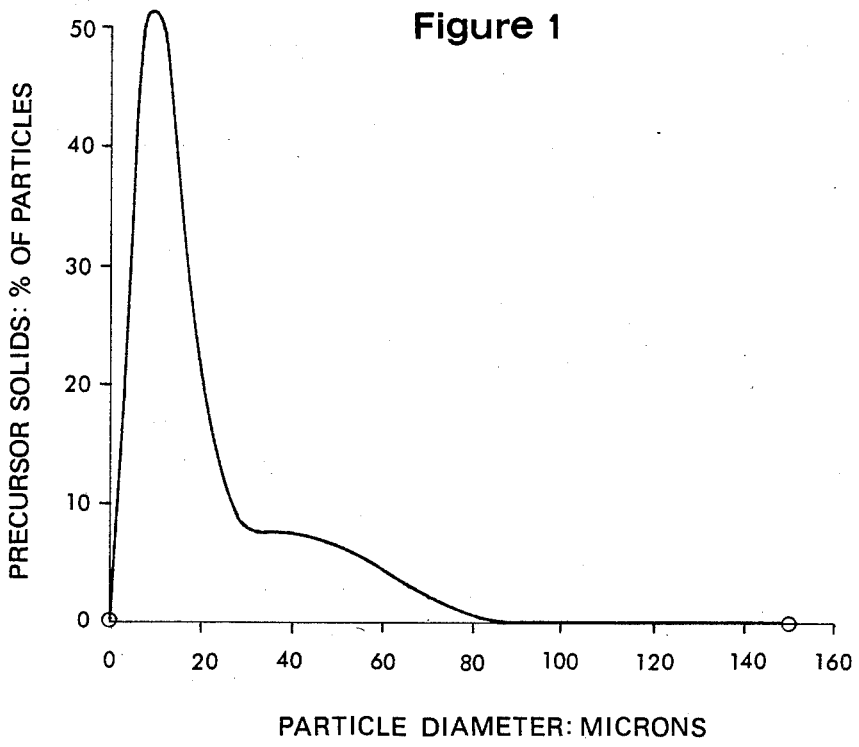

The molybdenum compounds in the slurry and colloidal states of the precursor are generally similar to each other in composition because of comparable sulfur levels, but the molybdenum compounds in the solution phase have a substantially different composition than the solids, i.e. are essentially ammonium heptamolybdate. In one precursor catalyst prepared, of the total molybdenum present in the catalyst, 12 weight percent is in the slurry state and 88 weight percent is in the solution and/or colloidal phases. The average particle diameter of the molybdenum compounds in the slurry state of the precursor catalyst is in the range of about 3 to 30 microns.

The final catalyst is prepared after the aqueous precursor is dispersed into the feed oil together with hydrogen sulfide and hydrogen at an elevated pressure and at a temperature higher than the temperature at which the precursor is prepared but lower than the temperature of the hydroprocessing reactor. The final catalyst is prepared at a higher pressure (preferably process pressure) as compared to the pressure at which the precursor is prepared (essentially at or closer to atmospheric pressure). The aqueous precursor slurry is agitated into an admixture with the feed oil by injection of a stream of hydrogen and hydrogen sulfide and the mixture under essentially the pressure of the hydroprocessing reactor is passed to a series of heating zones. In the series of heating zones (two, three, or more zones) the ammonium molybdenum oxysulfides/heptamolybdate is converted to essentially molybdenum disulfide, which is the final catalyst. The mixture containing the final catalyst (possibly without addition or removal of any stream) is passed through the hydroprocessing zone. The mixture increases in temperature in the hydroprocessing zone due to exothermic heat of reaction.

In one sample, the final catalyst is characterized by a moderate surface area of about 20 $m^2/g$, a moderate pore volume of about 0.05 cc/g, an average pore diameter of about 100 Å and an average particle diameter of about 6 microns. The average particle diameter is generally lower than the average particle diameter of the solids in the precursor slurry.

In the preparation of the precursor, undissolved molybdenum oxide in aqueous slurry can be dissolved by addition of an aqueous ammonia solution under the following typical conditions:

Pressure:
- atmospheric to 400 psi, generally;
- atmospheric to 40 psi, preferably;
- 15 to 30 psi, most preferably.

Temperature:
- 80° to 450° F., generally;
- 125° to 350° F., preferably;
- 150° to 250° F., most preferably.

$NH_3$/Mo Ratio:
- 0.1 to 0.6 pounds of ammonia per pound of Mo, generally;
- 0.18 to 0.44 pound/pound, preferably;
- 0.19 to 0.27 pound/pound, most preferably.

The resulting solution or aqueous slurry is then contacted with a hydrogen-hydrogen sulfide-containing gas stream under pressure and temperture conditions within the above ranges and with:

$H_2S$/Mo Ratio:
- 0.5 or greater SCF of $H_2S$/# generally; and
- 1 and 16 SCF/#, preferably; and
- 2 to 8 SCF/#, most preferably.

By varying the $NH_3$/Mo and the $H_2S$/Mo ratios, in the preparation of the precursor, catalyst activity, catalyst slurry concentration and particle size can be controlled.

The aqueous precursor catalyst is mixed with all or a portion of the feed oil stream using the dispersal power of the hydrogen-hydrogen sulfide recycle stream (and make-up stream, if any) and the admixture is passed through a plurality of heating zones. The heating zones can be three in number, identified as the heat exchanger, the preheater and the pretreater, to provide a time-temperature sequence which is necessary to complete the preparation of the final catalyst prior to flowing to the higher temperature exothermic hydroprocessing reactor zone. Following are the conditions in the heating zones:

| Three Heating Zones | |
|---|---|
| Heat Exchanger: | |
| Temperature °F.: | 150 to 350 |
| Residence time, Hr.: | sufficient to inhibit excessive coking, but preferably 0.05 to 0.5. |
| Flow regime: | *bubble to dispersed |
| Preheater: | |
| Temperature °F.: | 351 to 500 |
| Residence time, Hr.: | sufficient to inhibit excessive coking, but preferably 0.05 to 0.5. |
| Flow regime: | *bubble to dispersed |
| Pretreater: | |
| Temperature °F.: | 501 to 750 |
| Residence time, Hr.: | sufficient to inhibit excessive coking, but preferably 0.05 to 2. |
| Flow regime: | *bubble to dispersed |
| Partial pressures in all the heating zones, psi: | |
| Hydrogen: | 350 to 4500 |
| Hydrogen sulfide: | 20 to 400 |
| Gas circulation rates in all the heating zones: | |
| Hydrogen to oil ratio, SCF/B: | 500 to 10,000 |
| Hydrogen sulfide to Mo, SCF/lb: | 5 or greater |

*bubble: gas bubbles distributed in an oil medium. dispersed: oil droplets dispersed in a gas medium.

If desired, the preheater and pretreater zones can be merged into a single zone operated at a temperature between 351° and 750° F. for a time between 0.05 and 2 hours. The total pressure in the heating zones can be 500 to 5,000 psi. Also, if desired, a portion of the catalyst-free feed oil can be introduced between any high temperature-high pressure hydrogen sulfide treating zones. In addition, a process recycle slurry containing used catalyst can be directly recycled through all or any of these hydrogen sulfide heating zones.

Figure 17:
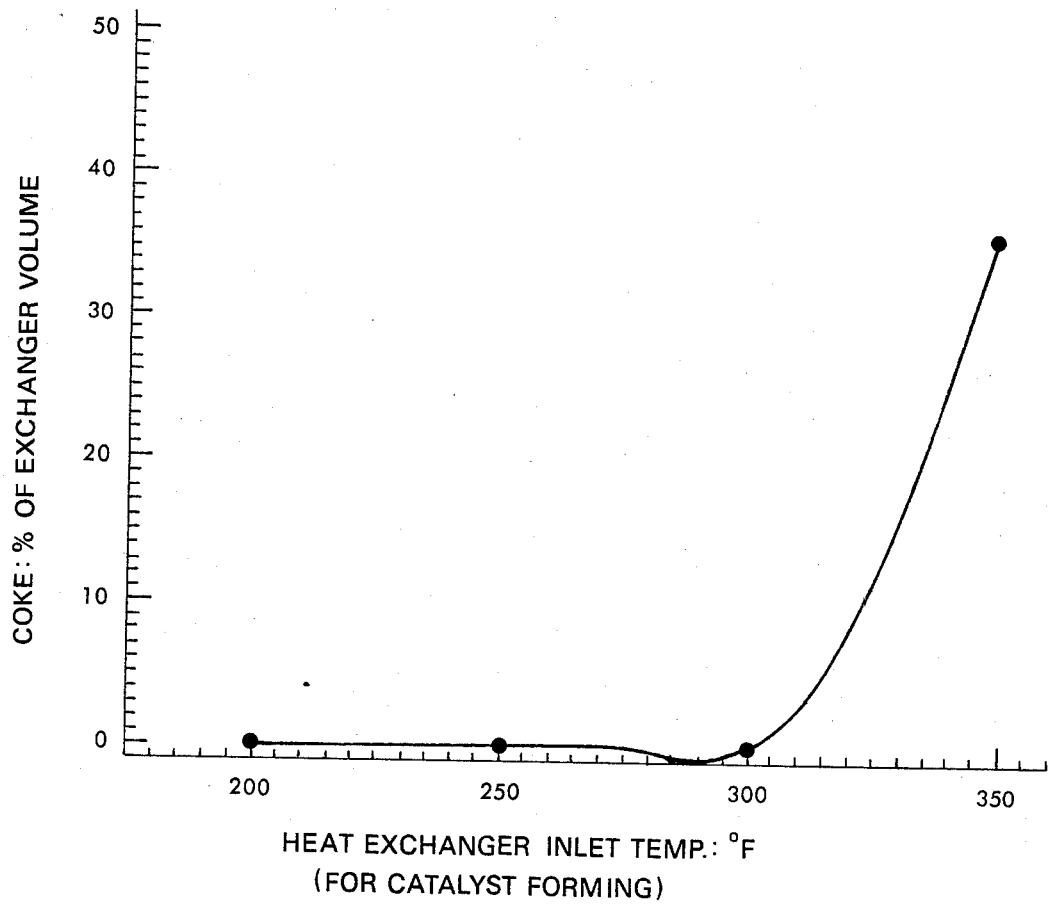
FIG. 17 shows the effect of heat exchanger inlet temperature on coking during the catalyst sulfiding step.

The reason for the prescribed residence time in the heat exchanger and other high temperature-high pressure sulfiding zones is based upon our discovery that the catalyst of this invention is surprisingly a very active coking catalyst, even at much lower temperatures than massive coking was observed heretofore. A precursor was prepared using an $NH_3$/Mo weight ratio of 0.23 and was sulfided at low-temperature and -pressure conditions using 2 SCF $H_2S$ per pound of Mo. This precursor was then mixed with West Texas VTB and sulfided at 2500 psi using heat exchanger inlet temperatures of 200° F., 250° F., 300° F., and 350° F., respectively. The results in terms of coking are shown in FIG. 17. FIG. 17 shows that minimal coking occurred at inlet temperature up to 300° F. However, at the 350° F. inlet temperature, massive coking occurred so that the coke filled almost 40 percent of the heat exchanger volume. This is surprising because coking is generally initiated at much higher temperatures. Therefore, the catalyst of this invention is an extremely active coking agent. We have found that this excessive coking can be depressed or avoided by using the slow heating regime of this invention, i.e. by practicing the prescribed residence times during heating in the high temperature-high pressure sulfiding zones.

Additional tests were performed to further characterize one particular precursor catalyst. A catalyst designated as catalyst 7, in Table I, was prepared for these tests. Catalyst 7 has the same $NH_3$/Mo ratio as catalyst 3, in Table I, which is shown below to be the optimum catalyst of Table I, but the molybdenum concentration was cut nearly in half and the $H_2S$/Mo ratio used to sulfide the catalyst precursor was increased from 1 to 2.7 SCF/pound of molybdenum.

TABLE I

| Catalyst Precursors:* Catalyst Number | 1 | 2 | 3 | 4 | 5 | 6 | 7 | 8 | 9 Molybdenum Blue | 10 Ammonium Tetra-Thio-Molybdate |
|---|---|---|---|---|---|---|---|---|---|---|
| Grams of Charge: | | | | | | | | | | |
| Molybdic Oxide ($MoO_3$) | 96.0 | 96.0 | 96.0 | 96.0 | 96.0 | 96.0 | 12.4 | 96.0 | — | — |
| $NH_4OH$ (29.2% as $NH_3$) | — | 34.4 | 51.6 | 43.0 | 68.8 | 86.0 | 6.7 | 137.6 | — | — |
| Distilled Water | 365.2 | 330.8 | 313.6 | 322.2 | 296.4 | 279.2 | 80.7 | 227.6 | 100.9 | 205.7 |
| Total | 461.2 | 461.2 | 461.2 | 461.2 | 461.2 | 461.2 | 100.0 | 461.2 | 131.5 | 238.6 |
| Wt. % Molybdenum | 13.9 | 13.9 | 13.9 | 13.9 | 13.9 | 13.9 | 7.9 | 13.9 | 12.8 | 6.7 |
| $NH_3$/Mo Wt. Ratio | 0.0 | .1562 | .2342 | .1952 | .3123 | .3904 | .2342 | .6247 | .15 | .37 |
| pH | 2.3 | 5.9 | — | — | — | 7.7 | | 9.6 | — | — |
| Sulfided Catalyst:** | | | | | | | | | | |
| Slurry Concentration, % Solids: wt. % | 50.0 | 46.8 | 6.1 | 2.4 | 6.1 | 2.0 | 12.0 | 6.1 | 2.0 | 0.0 |
| pH | 2.6 | 6.4 | — | — | — | — | — | 9.4 | — | — |
| Particle Size: % of Particles | | | | | | | | | | |
| 2.5–5 | 6.15 | 45.81 | 30.69 | 13.27 | 25.58 | 18.79 | 21.06 | 84.62 | 3.69 | — |
| 5–10 | 23.65 | 39.04 | 38.65 | 31.89 | 36.71 | 40.09 | 47.37 | 13.28 | 12.51 | — |
| 10–25 | 65.66 | 10.64 | 28.39 | 51.00 | 37.03 | 32.90 | 31.48 | 1.81 | 46.07 | — |
| 25–50 | 4.45 | 3.30 | 2.21 | 3.79 | 0.63 | 8.07 | 0.08 | 0.14 | 31.94 | — |
| 50–100 | 0.08 | 1.18 | 0.05 | 0.05 | 0.05 | 0.13 | 0.01 | 0.13 | 5.12 | — |
| 100–150 | 0.01 | 0.03 | 0.01 | 0.00 | 0.01 | 0.00 | 0.00 | 0.01 | 0.67 | — |
| >150 | 0.0 | 0.0 | 0.0 | 0.0 | 0.0 | 0.0 | 0.0 | 0.0 | 0.0 | 0.0 |
| Avg. Particle Diameter: | 15.2 | 8.7 | 9.9 | 13.3 | 10.5 | 12.6 | 9.9 | 4.6 | — | — |

TABLE I-continued

| Catalyst Precursors:* Catalyst Number | 1 | 2 | 3 | 4 | 5 | 6 | 7 | 8 | 9 Molybdenum Blue | 10 Ammonium Tetra-Thio-Molybdate |
|---|---|---|---|---|---|---|---|---|---|---|
| microns | | | | | | | | | | |

*Catalyst preps 1-8 reactions were performed at 150° F. and atmospheric pressure for 2 hrs., except for Catalyst 7 for which the reaction time was 1.5 hrs.
**Sulfiding was performed with a 92% $H_2$/8% $H_2S$ gas at 150° F., atmospheric pressure, 3.2 psi $H_2S$ partial pressure, 1 SCF $H_2S$ per lb. molybdenum, for 2 hrs.; except Catalyst 7 in which $H_2S$ charge rate was 2.7 SCF $H_2S$ per lb. molybdenum.

To determine the composition of precursor catalyst 7, the catalyst was filtered through a 0.2 micron laboratory filter and the filter cake dried. The total catalyst as prepared, the dried filter cake and the filtrate were sampled and analyzed. The total precursor catalyst as prepared exhibited the following ratios of elements:

N/Mo, atomic=1.23
S/Mo, atomic=0.69

Of the total precursor catalyst, 88 percent of the molybdenum present was contained in compounds whose particle diameter is smaller than 0.2 microns (nonfilterable colloids and molecules). These 88 percent of the compounds exhibited the following ratios of elements:

N/Mo, atomic=1.35
S/Mo, atomic=0.5

The remaining 12 percent of the molybdenum present in the precursor catalyst was contained in solid compounds whose diameter is larger than 0.2 microns (filterable). This 12 percent of the compounds exhibited the following ratios of elements:

N/Mo, atomic=0.72
S/Mo, atomic=1.4

All the ammonium salt compounds described above are precursor catalysts. The precursor compounds found in the slurry state, i.e. those whose particle diameter is 0.2 microns or larger, are characterized by the particle size distribution shown for catalyst 7 in Table 1, with an average particle diameter of 9.9 microns. The catalyst 7 of Table 1 precursor particle size distribution appears to be bimodal with nearly half of the particles having an average diameter of 5-10 microns, while nearly a third of the particles have an average diameter of 10-25 microns.

When filtering precursor catalyst through a 0.2 micron filter, it was found that after the first filtration, additional solids appeared in the clear filtrate in the absence of a hydrogen sulfide atmosphere. This observation and the bimodal nature of the catalyst particle size distribution make it appear that the precursor catalyst is an equilibrium mixture of ammonium molybdenum oxy-sulfide compounds distributed in the slurry, colloidal and soluble states.

To demonstrate the existence of ammonium molybdenum oxy-sulfide compounds in the colloidal and soluble states, a sample of catalyst 7 in Table I in the sulfided precursor catalyst slurry state was filtered through a 0.2 micron filter to remove the solids. Shortly after filtration, further precipitation was noticed in the filtrate. The filtrate was allowed to reach full equilibrium (24 hours) without a hydrogen sulfide atmosphere and was then refiltered through a 0.2 micron filter. Following is a tabulation of the results of these tests.

-continued

| | Wt of | Wt of Solids | Wt of Filtrate |
|---|---|---|---|
| | Feed to | From | From |
| First filtration | Basis: 100 | 7.6 | 92.4 |
| Second filtration | 92.4 | 3.6 | 88.8 |

| | Molybdenum | | Sulfur | | Nitrogen | |
|---|---|---|---|---|---|---|
| | Wt % of sample | Mole Ratio | Wt % of sample | Mole Ratio | Wt % of sample | Mole Ratio |
| Solids from first filtration | 47.0 | 1.0 | 19.65 | 1.3 | 5.0 | 0.73 |
| | (Possibly $(NH_4)_5Mo_7S_9O_{15}$) | | | | | |
| Solids from second filtration | 38.0 | 1.0 | 18.41 | 1.4 | 4.6 | 0.83 |
| | (Possibly $(NH_4)_6Mo_7S_{10}O_{14}$) | | | | | |
| Filtrate from second filtration (Mo probably in soluble and/or colloidal state) | 7.1 | 1.0 | 1.4 | 0.6 | 1.42 | 1.39 |

The above data tend to indicate that the precursor catalyst is an equilibrium mixture of ammonium molybdenum oxy-sulfide compounds distributed in the slurry, colloidal and soluble states, each having a distinctive composition.

In a particular precursor test, the compounds present in the cake from the first filtration (diameter greater than 0.2 microns) exhibited the following ratios of elements:

N/Mo, atomic=0.73
S/Mo, atomic=1.3

The compounds present in the cake from the second filtration in the same test exhibited the following ratios of elements:

N/Mo, atomic=0.83
S/Mo, atomic=1.4

Note the similarity of the above two ratios. In contrast, the compounds present in the filtrate from the second filtration in the same test exhibited the following ratios of elements:

N/Mo, atomic=1.35
S/Mo, atomic=0.58

The filtrate analyzed may have included a mixture of $NH_4HS$ or $(NH_4)_2S$ and soluble ammonium molybdenum oxysulfides, thus accounting for the sulfur in the filtrate. Note the substantial difference between the third set of ratios and the previous two sets of ratios. In particular, note that the soluble state compound (third set) is sulfided to a much lower extent than either the solid state or colloidal state compounds (previous two sets), indicating that a higher degree of sulfiding favors conversion of the soluble molybdenum compounds to colloidal and solid state compounds in equilibrium with each other.

The above discussion indicates that the precursor catalyst is not a single compound but an equilibrium mixture of several compounds. This hypothesis is enhanced by further tests which were conducted wherein a precursor slurry was filtered and the solids and filtrate were each separately subsequently sulfided and used as independent hydroprocessing catalysts. A portion of the unfiltered slurry was similarly subsequently sulfided and used as a hydroprocessing catalyst. It was found that the catalyst derived from the filtrate had a low hydrogenation activity. The catalyst derived from the filtered solids had a higher hydrogenation activity. The catalyst derived from the unfiltered mixture had a still higher hydrogenation activity. This constitutes a strong indication that the precursor catalyst is a mixture of several compounds.

As stated, of the total molybdenum present in the precursor slurry of catalyst 7 in Table 1, 12 weight percent was in the slurry state and 88 weight percent was in the colloidal and/or soluble states. Particle size data presented below afford evidence that the non-solid state segment of the precursor catalyst acts as a reservoir from which small particle size molybdenum sulfide final catalyst particles can be generated in subsequent heated sulfiding stages in advance of the hydroprocessing reactor. In order to produce smaller particle size compounds than are formed in the initial unheated precursor sulfiding step, the subsequent sulfiding steps must be performed at a temperature higher than the temperature used in sulfiding the precursor catalyst, but lower than the temperature of the hydroprocessing reactor, and with intermixed oil and water phases instead of with a water phase only. For this reason, the extent of the sulfiding of the catalyst must be controlled in the initial sulfiding step which occurs in the low temperature aqueous precursor stage.

The subsequent higher temperature sulfiding of the aqueous precursor slurry catalyst is performed after first dispersing the initially sulfided aqueous slurry into the feed oil with a hydrogen sulfide/hydrogen stream. If desired, a centrifugal pump or mechanical mixer can be used, but a mixing vessel is not required. The mixture comprising, hydrogen-hydrogen sulfide gas, feed oil, water and catalyst is then heated from about 150° F. up to the reactor inlet temperature under full process pressure in at least two or three separate heating stages, each at a higher temperature than its predecessor but below the temperature of the hydroprocessing reactor. In these heating stages the ammonium molybdenum oxysulfide compounds decompose in the presence of hydrogen sulfide to a highly activated form of small crystallite sulfided molybdenum, which is the final catalyst.

In a first heated sulfiding stage which can be at a temperature in the range 150°–350° F., ammonium molybdenum oxysulfides under hydrogen and hydrogen sulfide partial pressure presumably converts to a relatively higher sulfide of molybdenum. Subsequently, in a second heated sulfiding stage which can be at a temperature in the range 351° to 750° F., the higher sulfide of molybdenum, under hydrogen and hydrogen sulfide partial pressure, presumably converts to a highly active, relatively lower sulfide of molybdenum catalyst. It is highly unusual that although this latter conversion stoichiometrically evolves hydrogen sulfide, the desired catalytically active lower sulfide of molybdenum is not produced unless the reaction occurs in the presence of added hydrogen sulfide.

The following equations are proposed for the reactions believed to be involved.

| PRECURSOR FROM UNHEATED SULFIDING STEP | | FIRST HEATED SULFIDING STEP | | SECOND HEATED SULFIDING STEP | | FINAL CATALYST |
|---|---|---|---|---|---|---|
| AQ. $(NH_4)_xMoS_yO_z$ | $\xrightarrow{H_2/H_2S/Oil}$ | $MoS_w$ | $\xrightarrow{H_2/H_2S/Oil}$ | | | $MoS_2$ |

where w is about 3.

The amount of hydrogen sulfide required to convert ammonium molybdate to the active sulfided molybdenum final catalyst is about 7.9 SCF/# Mo. Therefore, if 1 SCF/# Mo is used in the unheated precursor stage, which is performed at a low temperature and pressure, then another 6.9 SF/# Mo of hydrogen sulfide is required in the subsequent heated sulfiding stages, which is performed at high temperature and pressure. It is unusual that this amount of hydrogen sulfide is required even if ammonium thiomolybdate is being treated, because ammonium thiomolybdate already contains within itself sufficient sulfur for conversion to the molybdenum disulfide catalyst of the prior art and is known to decompose to molybdenum disulfide without addition of hydrogen sulfide. This shows that the time-temperature history of the high temperature-high pressure reaction performed on the precursor catalyst with hydrogen sulfide is critical. As a practical matter, about 30 SCF of hydrogen sulfide per pound of molybdenum in the high temperature-high pressure sulfiding stages is required to help avoid coking reactions and to drive ammonium molybdenum oxysulfide to high activity $MoS_2$. Whatever amount of hydrogen sulfide is used in the high temperature-high pressure sulfiding stages is generally also present in the hydroprocessing reactor since the very same stream, generally without additions or removals, can pass through both the high temperature-high pressure sulfiding stages and the hydroprocessing reactor. If desired, even additional hydrogen sulfide and/or other system components can be injected into the hydroprocessing reactor. Regardless of whether or not additional hydrogen sulfide is added to the hydroprocessing reactor, the mixture of hydrogen, hydrogen sulfide, oil, water and catalyst must experience a series of prescribed time-temperature regimes (where the temperature of each regime is higher than its predecessor) before entering the hydroprocessing reactor, which is the zone of highest temperature. Each of these regimes is achieved by allowing a prescribed time duration while the temperature of the mixture remains within and is heated through a prescribed range. This series of time-temperature regimes must be observed whether the operation is batch or continuous. In a batch operation, it can be observed by heating the oil, water and catalyst feed within an autoclave at progressively increasing temperature levels for prescribed times, at each level, while continually circulating a hydrogen/-hydrogen sulfide mixture through the autoclave. In a continuous operation, each time-temperature regime can occur in a single heating coil, in a portion of a heating coil or in a plurality of heating coils.

Even though the relative amount of hydrogen sulfide injected into the unheated precursor zone is small compared to the amount injected in the heated sulfiding zones, it is critical that some hydrogen sulfide be injected into the unheated precursor zone. In this regard, see Table II in which the catalyst numbers correspond to the catalyst numbers in Table I.

TABLE II

| Catalyst | $NH_3$/Mo #/# | $H_2S$/Mo (SCF/#) | $H_2S.NH_3$ (SCF/#) | Final Catalyst (n-Heptane Insolubles) ← Atomic Ratios → S/Mo | O/Mo |
|---|---|---|---|---|---|
| 1 | 0.00 | 1.00 | | 0.18 | 1.36 |
| 2 | 0.16 | 1.00 | 6.25 | 1.42 | 0.42 |
| 3 | 0.23 | 1.00 | 4.34 | 2.38 | 0.77 |
| 4 | 0.19 | 1.00 | 5.26 | 2.11 | 0.35 |
| 5 | 0.31 | 1.00 | 3.22 | 2.22 | 0.33 |
| 6 | 0.39 | 1.00 | 2.56 | 1.61 | 1.16 |
| 8 | 0.62 | 1.00 | 1.61 | 2.42 | 0.40 |
| 9 | 0.15 | 0.01 | 0.06 | 1.21 | 0.57 |
| 10 | 0.37 | 16.00 | 43.24 | 2.16 | 0.32 |

| Catalyst | ← Yields → Oil | DAO | Asphalt | Delta API | Gravities Oil | DAO | Hydrogen Consumptions: (SCFB) Total | Oil |
|---|---|---|---|---|---|---|---|---|
| 1 | 63.5 | 23.1 | 5.5 | 10.4 | 27.1 | −2.7 | 592 | 394 |
| 2 | 69.9 | 16.3 | 4.3 | 24.7 | 36.9 | 18.7 | 1674 | 1475 |
| 3 | 73.2 | 15.3 | 2.9 | 26.7 | 37.8 | 24.0 | 1960 | 1541 |
| 4 | 58.5 | 29.5 | 3.4 | 27.0 | 39.5 | 28.2 | 1799 | 1428 |
| 5 | 77.0 | 13.9 | 1.9 | 24.6 | 35.1 | 23.6 | 1574 | 1311 |
| 6 | 67.0 | 22.7 | 1.4 | 23.4 | 35.4 | 22.6 | 1499 | 963 |
| 8 | 71.6 | 17.3 | 3.9 | 22.5 | 35.3 | 14.6 | 1123 | 968 |
| 9 | 75.8 | 9.0 | 1.9 | 15.5 | 25.4 | 14.7 | 861 | 175 |
| 10 | 78.8 | 12.3 | 1.6 | 22.9 | 32.4 | 26.5 | 1483 | 1179 |

| Catalyst | Desulfurization | Sulfur, wt. % Oil | DAO | ← Demetalation → Nickel | Vanadium | Total |
|---|---|---|---|---|---|---|
| 1 | 83.1 | 0.78 | 0.46 | 97.7 | 99.0 | 98.6 |
| 2 | 93.6 | 0.21 | 0.50 | 97.5 | 98.9 | 98.5 |
| 3 | 95.7 | 0.16 | 0.23 | 97.7 | 99.0 | 98.6 |
| 4 | 95.0 | 0.28 | 0.05 | 94.1 | 97.4 | 96.4 |
| 5 | 92.6 | 0.28 | 0.34 | 97.9 | 99.1 | 98.7 |
| 6 | 74.9 | 0.43 | 2.66 | 100.0 | 99.5 | 99.6 |
| 8 | 94.6 | 0.24 | 0.11 | 100.0 | 99.6 | 99.7 |
| 9 | 52.2 | 1.95 | 2.48 | 95.8 | 98.1 | 97.4 |
| 10 | 91.9 | 0.24 | 0.48 | 99.4 | 99.7 | 99.6 |

Catalysts 2 and 9 of Table II were each prepared with substantially the same $NH_3$/Mo ratio. However, catalyst 9 was treated with an $H_2S$/Mo ratio of only 0.01 SCF/# in the low temperature-low pressure precursor zone, while catalyst 2 was treated with a much higher $H_2S$/Mo ratio of 1.00 SCF/# in the low temperature-low pressure precursor zone, while both were treated substantially the same in the subsequent high temperature-high pressure sulfiding stages. As shown in Table II, catalyst 9 was only half as effective in the subsequent hydroprocessing reaction (described below), consuming only 861 SCF $H_2$/bbl, as compared to 1674 SCF $H_2$/bbl for catalyst 2. This shows clearly the criticality of the sulfiding step in the low temperature and pressure sulfiding stage, in which the $H_2S$/Mo ratio as SCF/pound should be 0.5 or greater.

The following equations will illustrate the criticality of the heated temperature-high pressure sulfiding stage for conversion of the ammonium salt precursor catalyst to the active final catalyst of this invention. As stated above, ammonium thiomolybdate contains sufficient sulfur for conversion to $MoS_2$ in the absence of an atmosphere of hydrogen sulfide. However, the presence of hydrogen sulfide during this conversion is required to produce an active form of $MoS_2$. Note the following equations:

$$(NH_4)_2MoS_4 \xrightarrow[\text{no } H_2S]{H_2 \text{ but}} MoS_w \xrightarrow[\text{no } H_2S]{H_2 \text{ but}} MoS_2 \text{ (not active)}$$

ammonium tetrathiomolybdate $$(NH_4)_2MoS_4 \xrightarrow{H_2/H_2S} MoS_w \xrightarrow{H_2/H_2S} MoS_2 \text{ (active)}$$

where w is about 3.

Although the above equations show that the active final catalyst is a sulfide of molybdenum having an atomic ratio S/Mo of 2, it cannot be characterized as conventional molybdenum disulfide but is a high activity form of $MoS_2$.

Figure 2:
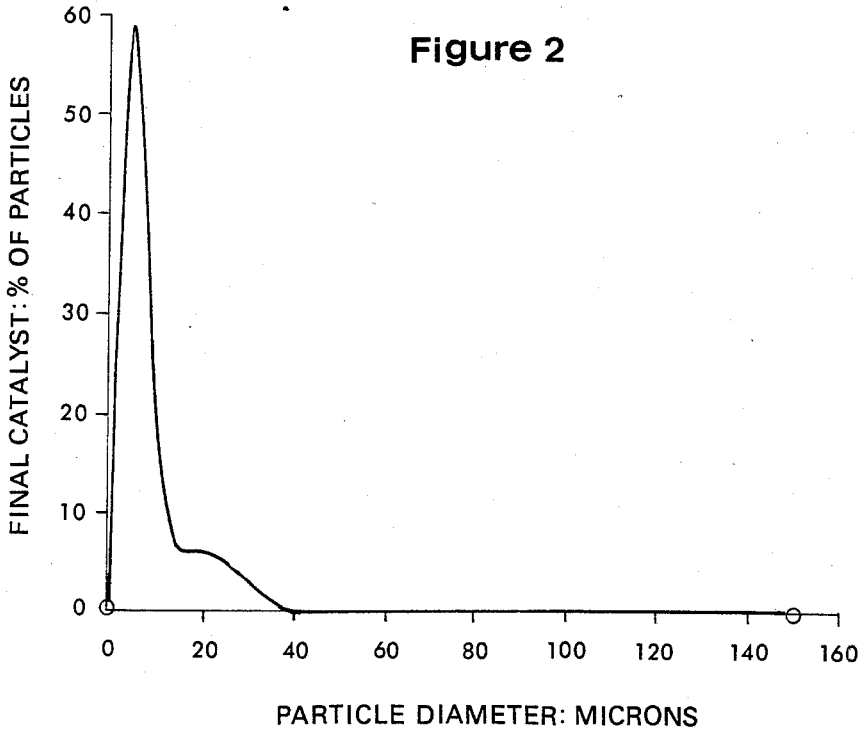

The particle size distribution of the precursor slurry solids after the unheated sulfiding step is shown in FIG. 1, and the particle size distribution of the final catalyst is shown in FIG. 2. The final catalyst can be easily separated from the reaction products emerging from a hydroprocessing reactor by solvent extracting a residue fraction with a light hydrocarbon solvent, such as propane, butane, light naphtha, heavy naphtha and/or diesel oil fractions. The extraction process is performed at low temperatures (150°-650° F.) and at a pressure sufficient to maintain the solvent totally in the liquid phase. Comparing the particle size distribution of the final catalyst as shown in FIG. 2 with the particle size distribution of the precursor catalyst shown in FIG. 1, it is seen that smaller particles are being generated during the high temperature-high pressure hydrogen sulfide treatment of the precursor catalyst than were present in the precursor catalyst. The average particle size of the final catalyst of FIG. 2 is only 6 microns, compared to an average particle size of 9.9 microns for the precursor catalyst of FIG. 1. As was the case with the precursor catalyst, the catalyst after the reactor exhibits a bimodal particle size distribution.

Figure 3:
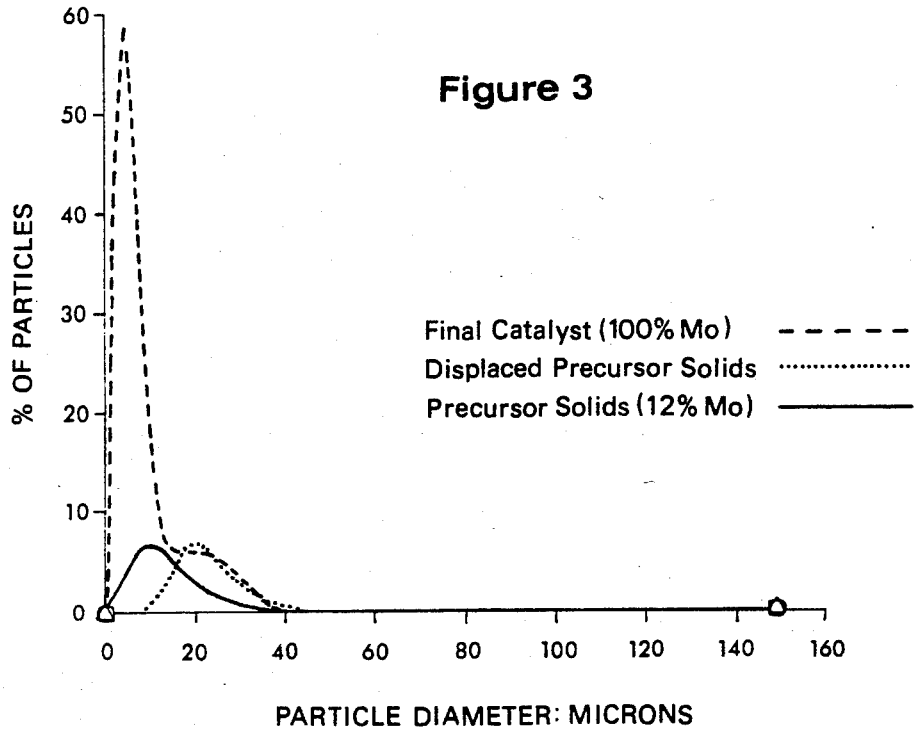

The size distribution of the solids in the precursor sulfided catalyst prior to high temperature sulfiding and in the final sulfided catalyst after the hydroprocessing reactor are compared in FIG. 3. The height of the curve for the precursor solids is corrected as compared to the curve for the final catalyst to reflect the fact that the precursor solids contained only 12 weight percent of the total molybdenum while the final catalyst solids contained 100 weight percent of the total molybdenum. As shown in FIG. 3, the second mode of the particle distribution of the final catalyst can be overimposed by the corrected particle distribution of the precursor catalyst. This is achieved by displacing the precursor catalyst's distribution by 10 microns, assuming particle agglomeration and carbonization in the hydroprocessing reactor increases the particle size of the precursor catalyst. This shifting corresponds to a doubling of the average particle diameter of the precursor catalyst. If this is valid it suggests that the catalyst particle after the reactor which are greater than 10 microns originated from the ammonium molybdenum oxy-sulfide compounds in the slurry state of the precursor catalyst.

If desired, the catalyst removed from a hydroprocessing reactor can be recovered from a V-tower bottoms product fraction by solvent deasphalting and then oxidizing the asphalt-free catalyst and oil-derived metals to regenerate. Table III presents and compares the catalyst particle sizes for a precursor catalyst prepared with an $NH_3$/Mo weight ratio of 0.15 and an $H_2S$/Mo SCF/# ratio of 1.0 before it enters and after it is removed from a batch reactor. It is noted that the average particle size of the catalyst increased during use. The catalyst removed from the batch reactor was recovered by deasphalting the product sludge with heptane. The oxidation of the sludge was performed at conditions typical of low temperature roasting, i.e. the sample was exposed to low concentrations of air at a temperature of only 250° F. This oxidation occurred with spontaneous combustion. It is highly unexpected that the catalyst of this invention can be oxidized spontaneously at such a low temperature. This is further evidence of the highly active nature of the catalyst of this invention. For comparison purposes, Table III also presents inspections for another catalyst (catalyst 7, Table I) prepared under different conditions including an optimized $NH_3$/Mo weight ratio, where the particle size is measured after a continuous hydroprocessing reactor. In this case, the average particle size was advantageously reduced during use, tending to increase catalyst activity.

TABLE III

| Operation | | ←Batch→ | | ←Continuous→ | |
|---|---|---|---|---|---|
| | | | | ←Catalyst 7→ | |
| $NH_3$/Mo: weight ratio | | ←0.15→ | | ←0.23→ | |
| $H_2S$/Mo ratio: SCF/# | | ←1.00→ | | | |
| | Prior to (fresh cat.) | ←After the Reactor→ Before Oxidizing | After Oxidizing | Prior to | After the Reactor |
| Typical Composition | | | | | |
| Sulfur: wt. % | — | 22.6 | 2.8 | — | 27.21 |
| Oxygen: wt. % | — | 3.1 | 32.3 | — | 2.11 |
| Molybdenum: wt. % | — | 31.2 | 54.6 | — | 45.00 |
| Nickel: wt. % | — | 0.06 | 0.11 | — | 0.10 |
| Vanadium: wt. % | — | 0.07 | 0.16 | — | 0.14 |
| Organic: wt. % (Carbon + Hydrogen) | — | 43.0 | 10.3 | — | 23.88 |
| Atomic Ratios | | | | | |
| Sulfur to Molybdenum | — | 2.17 | 0.16 | — | 1.81 |
| Oxygen to Molybdenum | — | 0.60 | 3.5 | — | 0.28 |
| Characterization | | | | | |
| Pore Volume: cc/g | — | 0.05 | — | — | — |
| Surface Area: $m_2$/g | — | 20.3 | — | — | — |
| Pore Diameter: Angstroms | — | 102 | — | — | — |
| Particle Size: % of Particles | | | | | |
| 2.5-5 microns | 11.32 | 2.87 | — | 21.06 | 57.83 |
| 5-10 | 20.06 | 13.19 | — | 43.37 | 35.52 |
| 10-25 | 52.14 | 56.09 | — | 31.48 | 5.98 |
| 25-50 | 6.41 | 27.76 | — | 0.08 | 0.57 |
| 50-100 | 0.06 | 0.09 | — | 0.01 | 0.09 |
| 100-150 | 0.00 | 0.00 | — | 0.00 | 0.01 |
| >150 | 0.00 | 0.00 | — | 0.00 | 0.0 |
| Avg. Particle Diameter dp: micron | 14.2 | 21.4 | — | 9.9 | 6.2 |

While the present slurry catalyst is not essentially acidic and therefore the catalyst itself does not impart hydrocracking activity, the circulating hydrogen sulfide is a mildly acidic process component which contributes some cracking activity. Data presented below show that the activity imparted through hydrogen sulfide injection or recycle, or both, can be achieved using any catalyst and even can be achieved in the absence of an added catalyst, so that the hydrogen sulfide activity effect is not limited to the particular slurry catalyst described herein.

The small particle size contributes to the high catalytic activity of the catalyst particles of this invention. The catalyst particles of the present invention are generally sufficiently small to be readily dispersed in a heavy oil, allowing the oil to be easily pumped. If the particles are present in a product fraction of the lubricating oil range, they are sufficiently small to pass through an automotive engine filter. If the particles dispersed in a lubricating oil fraction are too large to pass through an automotive filter, the catalyst in the oil fraction can be reduced in size using a ball mill pulverizer until the particles are sufficiently small that such passage is possible. Since $MoS_2$ is an excellent lubricating material, a lubricating oil range product fraction of this invention is enhanced in lubricity because of its $MoS_2$ content.

An important feature of the catalytic mode of the present invention is that moderate or relatively large amounts of any vanadium and nickel removed from a crude or residual feed oil and deposited upon or carried away with the molybdenum disulfide crystallite during the process do not significantly impair the activity of the catalyst. In fact, data presented below show that vanadium can constitute as much as 70 to 85 weight percent of the circulating metals without excessive loss of activity. An effective circulating catalyst can comprise molybdenum and vanadium in a 50—50 weight ratio. It is an important feature of the catalytic mode of this invention that during regeneration of the catalyst upon recycle, the amount of ammonia added to solvate the catalytic metal is determined by the quantity of recycle molybdenum plus make-up molybdenum reacting with and dissolved by the ammonia and is in no way affected by the amount of vanadium and nickel and other metal accumulated by the molybdenum during the reaction. Therefore, the critical $NH_2$/Mo ratio specified herein for preparation of the precursor catalyst in the absence of recycle is not changed when treating a stream or batch of recycle plus make-up molybdenum catalyst, where the recycle molybdenum contains vanadium and/or nickel.

The catalyst of the present invention is adapted to promote hydrogenation reactions under moderate temperatures while depressing coke and asphalt yields. The hydrogenation reactions are performed at a temperature above 705° F., which is the critical temperature of water, or at lower temperatures in conjunction with a pressure at which water will be partially or totally in the vapor phase. Therefore, the large amount of water introduced to the hydroprocessing reactor with the slurry catalyst passes entirely, mostly or at least partially into the vapor phase. The high temperature-high pressure hydrogen sulfide treatment for producing the final catalyst is performed at a temperature below the critical temperature of water, so that the water is at least at some point or throughout in the liquid phase during said sulfiding. In the hydrogenation process, asphaltenes tend to be upgraded via conversion to lower boiling oils without excessive coke formation. At the same time the oil undergoes hydrodesulfurization and demetalation reactions.

Although the starting material for preparing the present catalyst is preferably molybdenum trioxide ($MoO_3$), an oxide of molybdenum as such is neither a catalyst nor a catalyst precursor. The $MoO_3$ is converted to a precursor sulfide of molybdenum having an atomic S/Mo ratio of about 7/12 when the molybdenum oxide is reacted first with ammonia and then with hydrogen sulfide. We have found that the ratio of ammonia to molybdenum and the ratio of hydrogen sulfide to molybdenum used in preparing the catalyst precursor, under substantially atmospheric pressure, as well as the temperature and other conditions of the subsequent high temperature-high pressure hydrogen sulfide treatment, are all critical to catalyst activity.

In preparing the catalyst precursor, various amounts of ammonium hydroxide were added to constant amounts of a slurry of molybdenum trioxide in distilled water. Table 1 presents details of preparation for ten catalysts. Table 1 shows that various $NH_3$/Mo weight ratios (pounds of ammonia per pound of molybdenum as metal) were used in preparing the ten catalysts.

The resulting slurries were stirred and heated to 150° F. at atmospheric pressure. This temperature was maintained for a duration of two hours during which time ammonia reacted with molybdenum trioxide to form ammonium molybdate. Thereupon, a hydrogen sulfide-containing gas (92 percent hydrogen and 8 percent hydrogen sulfide) was introduced at atmospheric pressure. Table II shows that the flow of gas and the sulfiding duration was such that 1.0 SCF of hydrogen sulfide gas was contacted per pound of molybdenum (as metal) for all the catalysts, except catalysts 9 and 10. The precursor sulfiding conditions were as follows:

Temperature: 150° F.
Pressure: Atmospheric
$H_2S$ partial pressure: 3.2 psi
$H_2S$/Mo ratio: 1.0 SCF/# Mo (as metal)

At the end of the sulfiding step, preparation of the catalyst precursor was complete. The flow of hydrogen sulfide was stopped and the catalyst precursor was cooled to room temperature. Somewhat different conditions are noted in Table I for catalyst 7.

Catalysts 9 and 10 of Table 1 are precursors identified as "molybdenum blue" and ammonium(tetra) thiomolybdate $(NH_4)_2MoS_4$, respectively. These two catalysts were included in the series to illustrate the effect of the SCF $H_2S$/pound Mo ratio employed in the preparation of the precursor catalyst. These catalyst precursors show that there are effective lower and upper limits of this ratio. Table II shows that the ratio of hydrogen sulfide to molybdenum (as the metal) is 0.01 and 16 for molybdenum blue and ammonium thiomolybdate, respectively.

The "molybdenum blue" was prepared by the following procedure:

1. 30.6 grams of ammonium paramolybdate (also known as ammonium heptamolybdate, $(NH_4)_6Mo_7O_{24}.4H_2O$, were dissolved in 111 grams of distilled water.

2. The resulting ammonium paramolybdate solution was stirred and heated to 150° F. During this time, a small purge of nitrogen flow was maintained.

3. Once the solution reached the above temperature, with no evidence of solids in the liquid, a flow of hydrogen sulfide containing gas (92% hydrogen-8% hydrogen sulfide) was momentarily introduced and maintained until the solution color turned to blue, with evidence of colloidal particles being formed. This product was "molybdenum blue".

The ammonium thiomolybdate used was commercial ammonium thiomolybdate and was prepared by two equivalent procedures, either from molybdenum trioxide or ammonium heptamolybdate.

When ammonium heptamolybdate was used, the procedure was as follows: An amount of ammonium heptamolybdate tetrahydrate, 100 grams (0.081 moles), was dissolved in a solution composed of 300 milliliters of distilled water and 556 milliliters of ammonium hydroxide solution (29.9 weight percent ammonia). Hydrogen sulfide gas was bubbled into the solution for about one hour. The red-brown crystals of the resulting ammonium thiomolybdate were vacuum filtered, washed with acetone, and dried in the atmosphere. The weight of the dried product was 134.9 grams (92.4% yield).

When molybdenum oxide was used, an amount of molybdenum trioxide, 25.0 grams (0.174 moles), was dissolved in a solution composed of 94 milliliters of distilled water and 325 milliliters of ammonium hydroxide (29.9 weight percent ammonia). Hydrogen sulfide gas was bubbled through this solution for about one hour, causing precipitation of red-brown crystals of the product. The red-brown crystals of the resulting ammonium thiomolybdate were vacuum filtered, washed with acetone, and air dried. The weight of the resulting ammonium tetrathiomolybdate was 43.3 grams (96.5% yield).

Figure 4:
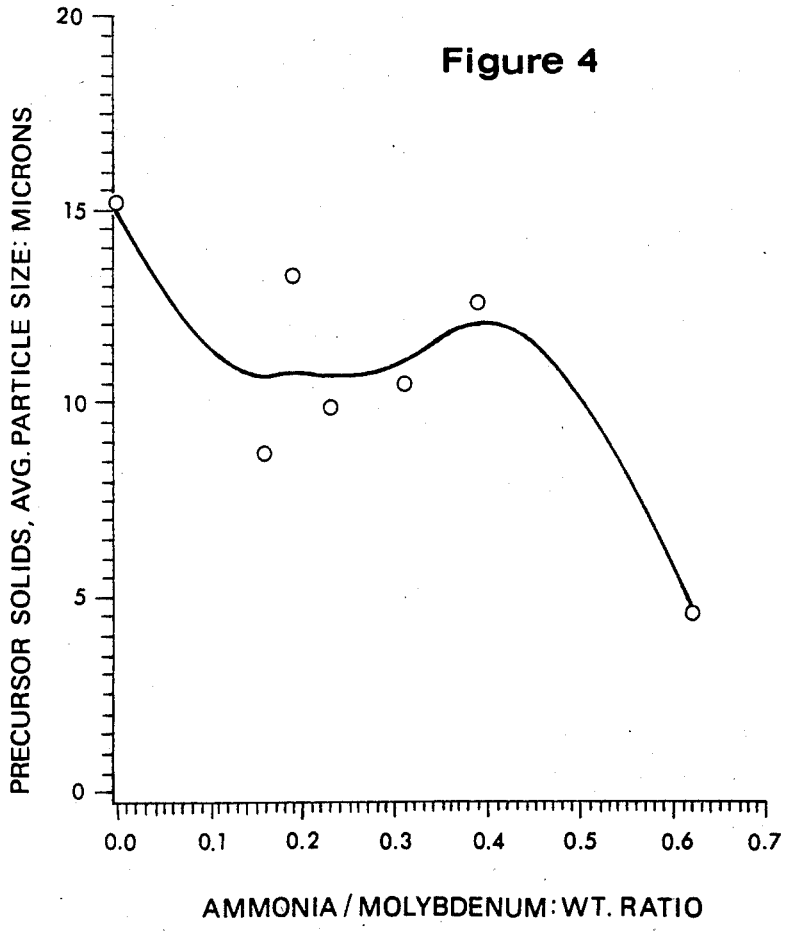

FIG. 1 reports the average particle diameter in microns of the solid particles in the precursor slurries obtained after sulfiding. FIG. 4 graphically relates average particle size to the $NH_3$/Mo weight ratio at a constant $H_2S$/Mo weight ratio and shows that catalyst particle size decreased at the highest $NH_3$/Mo ratios used.

Figure 5:
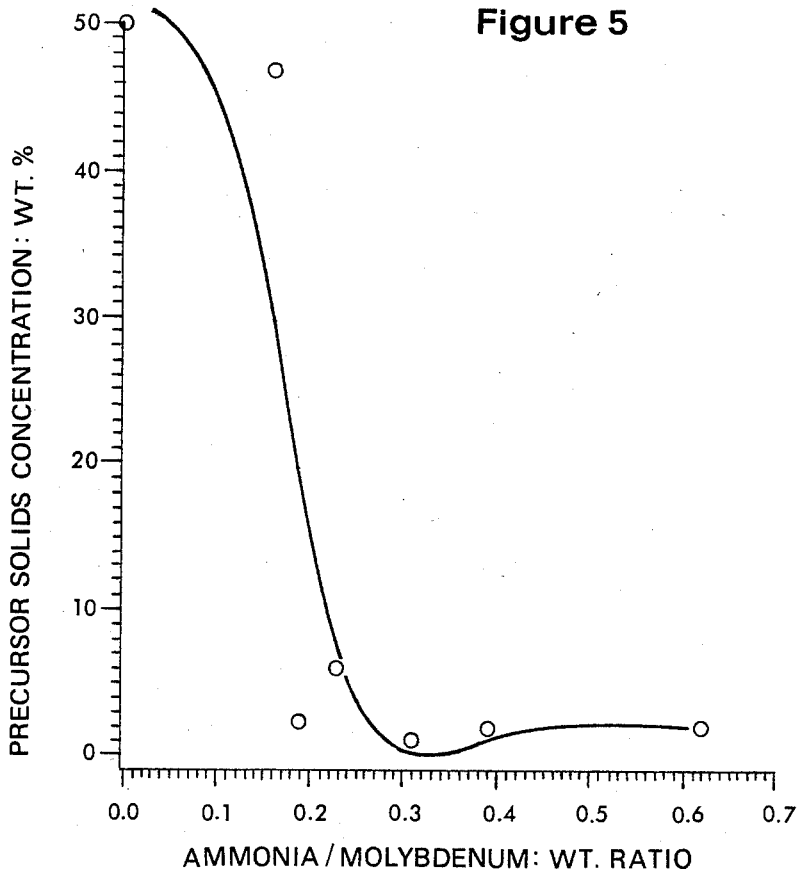

Table I reports the concentration of solids (weight percent) in the catalyst precursor slurries. FIG. 5 graphically relates the solids concentration to the $NH_3$/Mo weight ratio at a constant $H_2S$ to Mo ratio. Referring to FIG. 5, an $NH_3$/Mo ratio of 0.0 indicates a catalyst precursor prepared from $MoO_3$ only, without addition of $NH_3$, i.e. unreacted with $NH_3$. The maximum solubilization of the catalyst occurs upon use of an $NH_3$/Mo ratio of at least about 0.2 to 0.3, with no significant improvement when using a ratio above this level. A low slurry concentration indicates a substantial proportion of the precursor is in the colloidal and soluble states. As shown above, it is the material in the colloidal and soluble states that provides the smallest particles in the final catalyst.

The individual ammonium salt precursor catalysts described in Table I (excepting catalyst 7) were subsequently sulfided to produce a final catalyst and then used in an autoclave for hydroprocessing a West Texas vacuum tower bottoms feedstock, having the following specifications:

| WEST TEXAS VTB - SPECIFICATIONS | |
|---|---|
| Gravity, D287: API | 8.7 |
| Specific Gravity | 1.0093 |
| Viscosities, SUS | |
| @ 210° F. | 2600 |
| @ 250° F. | — |
| Sulfur: wt. % | 3.56 |
| Nitrogen: wt. % | 0.44 |
| Oxygen: wt. % | — |
| Hydyrogen: wt. % | 10.65 |
| Carbon: wt. % | 83.35 |
| Water: wppm | — |
| Carbon Residue, Con.: wt.% | 18.5 |
| Metals: wppm | — |
| Nickel | 25. |
| Vanadium | 44. |
| Distillation, D1160 | |
| 5% | 888. |
| 10% | 896. (cracked) |

| Saturates | Aromatics | Cmpds. | Polar Insol. | n-Hexane |
|---|---|---|---|---|
| Wt. % of Sample | 15.2 | 55.7 | 20.5 | 8.6 |
| Carbon: wt. % | 85.89 | 84.60 | 82.21 | 83.53 |
| Hydrogen: wt. % | 13.60 | 10.23 | 9.10 | 7.30 |
| Nitrogen: wt. % | 0.006 | 0.250 | 0.81 | 0.97 |
| Oyxgen: wt. % | 0.06 | 0.71 | 3.33 | 1.55 |
| Sulfur: wt. % | 0.08 | 3.99 | 4.68 | 6.17 |
| Nickel: wppm | 12. | 12. | 12. | 100. |
| Vanadium: wppm | 24. | 24. | 24. | 250. |
| H/C, atomic | 1.90 | 1.45 | 1.33 | 1.05 |

The aqueous precursor catalyst and feed oil for each test were charged to a cold autoclave and remained in the autoclave throughout, while a mixture of hydrogen sulfide and hydrogen was continuously circulated through the autoclave while bubbling through the oil during the entire test to provide the requisite hydrogen sulfide circulation rate as well as the requisite hydrogen sulfide partial pressure. The high temperature-high pressure sulfiding operation was accomplished by gradually heating the autoclave containing the feed oil and catalyst while circulating hydrogen sulfide at a rate of about 40 SCF/#Mo through the autoclave. Within the autoclave, there was about 4.0 SCF/#Mo of hydrogen sulfide at all times. The catalyst sulfiding was performed in two stages, by first heating and holding the autoclave during sulfiding at a temperature of 350° F. for 0.1 hours, and again heating and then holding the autoclave at a temperature of 680° F. for 0.5 hours to produce the final catalyst. Thereupon, the autoclave was further heated to hydroprocessing temperature where it remained to the completion of each test.

Table IV presents detailed process conditions and detailed yields for each autoclave test. High hydrogen consumption and high delta API values represent good catalyst activity. Table IV shows that for the West Texas ATB feedstock, the highest hydrogen consumption and highest delta API values were achieved with the catalysts prepared with $NH_3$/Mo ratios of 0.19 and 0.23. Poorer results were achieved with catalysts prepared with lower $NH_3$/Mo ratios. The best results were achieved with a catalyst prepared with an $NH_3$/Mo weight ratio of 0.23.

TABLE IV

| Feedstock: West Texas VTB<br>Catalyst Number | 1 | | 2 | | 3 | | 4 | | 5 | | 6 | | 8 | | 9 | | 10 | |
|---|---|---|---|---|---|---|---|---|---|---|---|---|---|---|---|---|---|---|
| $NH_3$/Mo Ratio | 0.00 | | 0.1562 | | 0.2342 | | 0.1952 | | 0.31 | | 0.39 | | 0.62 | | 0.15 | | 0.37 | |
| Reaction Conditions | | | | | | | | | | | | | | | | | | |
| Reactor Pressure: psig | 2550.0 | | 2500.0 | | 2500.0 | | 2550.0 | | 2500.0 | | 2550.0 | | 2550.0 | | 2500.0 | | 2500.0 | |
| Rates | | | | | | | | | | | | | | | | | | |
| Gas Circ: SCFB | 629.2 | | 613.0 | | 595.6 | | 630.2 | | 605.5 | | 617.5 | | 628.7 | | 605.4 | | 617.0 | |
| Hydrogen: SCFB | 5185.5 | | 11323.5 | | 9639.4 | | 5726.7 | | 7056.2 | | 13986.0 | | 4353.2 | | 7822.1 | | 6141.5 | |
| $H_2S$: SCF/Lb. (Cat.) | 30.4 | | 66.2 | | 57.8 | | 33.6 | | 41.4 | | 82.5 | | 25.6 | | 51.0 | | 37.5 | |
| Reactor Temp.: °F. | 811.0 | | 826.0 | | 809.0 | | 809.0 | | 819.0 | | 815.0 | | 812.0 | | 823.0 | | 811.0 | |
| Time at Temp.: Hrs. | 2.0 | | 2.0 | | 2.0 | | 2.0 | | 2.0 | | 2.0 | | 2.0 | | 2.0 | | 2.0 | |
| Cat/Oil Ratio | 0.042 | | 0.042 | | 0.041 | | 0.042 | | 0.42 | | 0.042 | | 0.042 | | 0.038 | | 0.040 | |
| Molybdenum | 0.042 | | 0.042 | | 0.041 | | 0.042 | | 0.042 | | 0.042 | | 0.042 | | 0.038 | | 0.040 | |
| Weight Balance | 96.20 | | 96.46 | | 97.98 | | 102.37 | | 97.07 | | 85.28 | | 105.54 | | 101.31 | | 99.31 | |
| Yields: % | Wt. | Vol. | Wt. | Vol. | Wt. | Vol. | Wt. | Vol | Wt. | Vol. | Wt. | Vol. | Wt. | Vol. | Wt. | Vol. | Wt. | Vol. |
| Hydrogen | −0.88 | | −2.50 | | −2.93 | | −2.69 | | −2.35 | | −2.24 | | −1.75 | | −1.26 | | −2.21 | |
| Hydrogen Sulfide | 3.15 | | 3.54 | | 3.62 | | 3.59 | | 3.51 | | 2.83 | | 3.58 | | 1.98 | | 3.48 | |
| Ammonia | 0.26 | | 0.45 | | 0.48 | | 0.50 | | 0.46 | | 0.33 | | 0.48 | | 0.09 | | 0.47 | |
| Refinery Gas | | | | | | | | | | | | | | | | | | |
| Methane | 0.41 | | 0.34 | | 0.22 | | 0.45 | | 0.14 | | 0.51 | | 0.45 | | 0.90 | | 0.27 | |
| Ethane | 1.01 | | 2.99 | | 2.60 | | 2.54 | | 1.68 | | 2.40 | | 1.81 | | 3.10 | | 1.02 | |
| Ethylene | 0.03 | | 0.0 | | 0.0 | | 0.0 | | 0.0 | | 0.0 | | 0.03 | | 0.04 | | 0.01 | |
| Propanes | | | | | | | | | | | | | | | | | | |
| Propane | 2.97 | 5.9 | 2.24 | 4.4 | 2.92 | 5.8 | 2.41 | 4.8 | 2.42 | 4.8 | 3.32 | 6.6 | 1.55 | 3.1 | 4.49 | 8.9 | 3.37 | 6.7 |
| Propylenes | 0.01 | 0.0 | 0.0 | 0.0 | 0.0 | 0.0 | 0.0 | 0.0 | 0.0 | 0.0 | 0.0 | 0.0 | 0.0 | 0.0 | 0.78 | 1.5 | 0.0 | 0.0 |
| Butanes | | | | | | | | | | | | | | | | | | |
| I—Butane | 0.16 | 0.3 | 0.08 | 0.1 | 0.47 | 0.8 | 0.33 | 0.6 | 0.36 | 0.6 | 0.47 | 0.8 | 0.23 | 0.4 | 0.59 | 1.1 | 0.22 | 0.4 |
| N—Butane | 0.51 | 0.9 | 2.26 | 3.9 | 1.27 | 2.2 | 1.19 | 2.1 | 0.84 | 1.5 | 1.12 | 1.9 | 0.85 | 1.5 | 1.76 | 3.0 | 0.73 | 1.3 |
| Butenes | 0.0 | 0.0 | 0.0 | 0.0 | 0.0 | 0.0 | 0.0 | 0.0 | 0.0 | 0.0 | 0.0 | 0.0 | 0.00 | 0.0 | 0.02 | 0.0 | 0.00 | 0.0 |
| Pentanes | | | | | | | | | | | | | | | | | | |
| I—Pentane | 0.09 | 0.1 | 0.05 | 0.1 | 0.0 | 0.0 | 0.0 | 0.0 | 0.09 | 0.2 | 0.07 | 0.1 | 0.0 | 0.0 | 0.33 | 0.5 | 0.00 | 0.0 |
| N—Pentane | 0.12 | 0.2 | 0.06 | 0.1 | 0.0 | 0.0 | 0.21 | 0.3 | 0.08 | 0.1 | 0.06 | 0.1 | 0.0 | 0.0 | 0.46 | 0.7 | 0.00 | 0.0 |
| Pentanes | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 |
| Hexanes + | 0.0 | 0.0 | 0.0 | 0.0 | 0.0 | 0.0 | 0.01 | 0.0 | 0.0 | 0.0 | 0.0 | 0.0 | 0.0 | 0.0 | 0.0 | 0.0 | 0.00 | 0.0 |
| Liquid Oil Product | 63.52 | 71.9 | 69.88 | 83.9 | 73.17 | 88.4 | 58.50 | 71.3 | 77.01 | 91.5 | 67.02 | 79.8 | 71.59 | 85.2 | 75.82 | 84.9 | 78.77 | 92.1 |
| Deasphalted Oil | 23.13 | 21.3 | 16.35 | 17.5 | 15.26 | 16.9 | 29.51 | 33.7 | 13.89 | 15.4 | 22.75 | 25.0 | 17.26 | 18.0 | 8.98 | 9.4 | 12.31 | 13.9 |
| Coke | 5.52 | | 4.25 | | 2.92 | | 3.45 | | 1.87 | | 1.37 | | 3.91 | | 1.90 | | 1.57 | |
| Total | 100.00 | 100.5 | 100.00 | 110.1 | 100.00 | 114.1 | 100.00 | 112.9 | 100.00 | 114.1 | 100.00 | 114.4 | 100.00 | 108.1 | 100.00 | 110.1 | 100.00 | 114.3 |
| Slurry/Oil Ratio | 0.0559 | | 0.0824 | | 0.0635 | | 0.0514 | | 0.0586 | | 0.0568 | | 0.0567 | | 0.0339 | | 0.0374 | |
| Sulfur | 0.0026 | | 0.0209 | | 0.0157 | | 0.0213 | | 0.0253 | | 0.0108 | | 0.0143 | | 0.0072 | | 0.0154 | |
| Nickel | 0.0001 | | 0.0000 | | 0.0001 | | 0.0000 | | 0.0000 | | 0.0000 | | 0.0000 | | 0.0000 | | 0.0000 | |
| Molybdenum | 0.0429 | | 0.0437 | | 0.0287 | | 0.0302 | | 0.0340 | | 0.0324 | | 0.0297 | | 0.0275 | | 0.0212 | |
| Iron | | | | | | | | | 0.0 | | 0.0 | | 0.0 | | 0.0 | | 0.0 | |
| Vanadium | 0.0001 | | 0.0001 | | 0.0001 | | 0.0000 | | 0.0000 | | 0.0000 | | 0.0000 | | 0.0000 | | 0.0000 | |
| Conversion | | | | | | | | | | | | | | | | | | |
| Hydrogen Consumption: SCFB | 592. | | 1674. | | 1960. | | 1799. | | 1574. | | 1499. | | 1171. | | 843. | | 1483. | |
| % Desulfurization | 83.1 | | 93.6 | | 95.7 | | 95.0 | | 92.6 | | 74.9 | | 94.6 | | 52.2 | | 91.9 | |
| % Demetalation | 98.6 | | 98.5 | | 98.6 | | 96.4 | | 98.7 | | 99.6 | | 99.7 | | 97.4 | | 99.6 | |
| % Nickel Removed | | 97.7 | | 97.5 | | 97.7 | | 94.1 | | 97.9 | | 100.0 | | 100.0 | | 95.8 | | 99.4 |
| % Vanadium Removed | | 99.0 | | 98.9 | | 99.0 | | 97.4 | | 99.1 | | 99.5 | | 99.6 | | 98.1 | | 99.7 |
| Delta API | 15.5 | | 29.6 | | 31.7 | | 31.5 | | 28.7 | | 28.9 | | 25.5 | | 25.3 | | 27.8 | |

In Table IV and subsequently, the terms "liquid oil product", "deasphalted oil" and "coke" have the following meanings. The "liquid oil product" is the filtrate obtained by filtering the hydroprocessing product. The sludge on the filter is treated with heptane, and the portion of the sludge soluble in the heptane is "deasphalted oil". Therefore, the "liquid oil product" and the "deasphalted oil" are mutually exclusive materials. The portion of the product in the filter sludge not soluble in heptane is asphalt and is reported as "coke". The sludge on the filter also contains catalyst, but this is not a yield based on feed oil and is not reported in the product material balance.

The quality of the product fractions obtained from these West Texas VTB feedstock tests is shown in Table V. The product specifications shown include the devaporized oil product (product clear liquid), the deasphalted oil product, the deasphalted oil including heptane solvent, and the centrifuged solids. Table V shows that the highest API gravity oil product was achieved with the catalysts prepared with $NH_3$/Mo ratios of 0.19 and 0.23.

Table II, presented earlier, provides a summary of the results obtained from the West Texas vacuum residue hydroprocessing tests. These results are related to the $NH_3$/Mo and the $H_2S$/Mo ratios employed in preparing the precursor catalysts. The results are also illustrated in the graphs presented in the figures discussed below.

Referring to Table II, it is seen that catalysts 4 and 3, having $NH_3$/Mo weight ratios of 0.19 and 0.23, respectively, provided the highest hydrogen consumptions (1799 and 1960 SCF/B, respectively). Therefore, catalysts 4 and 3 were the most active hydrogenation catalysts.

As was pointed out above, Table II shows the importance of adequate low temperature-low pressure hydrogen sulfide treatment of the precursor catalyst. Compare catalysts 9 and 2, prepared using the very similar $NH_3$/Mo weight ratios of 0.15 and 0.16, respectively, but using the very different $H_2S$/Mo ratios of 0.01 and 1.00, respectively. Catalyst 2, using an $H_2S$/Mo ratio of 1.00 during precursor preparation, exhibited about twice the hydrogenation activity of catalyst 9, using an $H_2S$/Mo ratio of only 0.01 during precursor preparation

TABLE V

| Catalyst Number | 1 | 2 | 3 | 4 | 5 | 6 | 8 | 9 | 10 |
|---|---|---|---|---|---|---|---|---|---|
| Percent Molybdenum | 13.9 | 13.9 | 13.9 | 13.9 | 13.9 | 13.9 | 13.9 | 12.8 | 6.7 |
| $NH_3$/Mo Ratio | 0.0 | 0.1562 | 0.2342 | 0.1952 | 0.3123 | 0.3904 | 0.6247 | 0.15 | 0.37 |
| Feedstock: West Texas VTB | | | | | | | | | |
| INSPECTIONS | | | | | | | | | |
| Oil Product ($H_2S$ Stripped) | | | | | | | | | |
| Gravity, API | 27.1 | 36.9 | 37.8 | 39.5 | 35.1 | 35.4 | 35.3 | 25.4 | 32.4 |
| Specific Gravity | .8922 | .8403 | .8358 | .8275 | .8493 | .8478 | .8483 | .9018 | .8633 |
| Sulfur, wt. % | 0.78 | 0.21 | 0.16 | 0.28 | 0.28 | 0.43 | 0.24 | 1.95 | 0.29 |
| Nitrogen, wt. % | 0.203 | 0.029 | 0.024 | 0.008 | 0.038 | 0.146 | 0.024 | 0.403 | 0.025 |
| Carbon, wt. % | 86.93 | 86.39 | 86.81 | 86.06 | 87.33 | 86.62 | 86.64 | 85.79 | 87.17 |
| Hydrogen, wt. % | 11.85 | 13.43 | 13.37 | 13.18 | 12.83 | 12.19 | 12.38 | 11.05 | 12.51 |
| Oxygen, wt. % | 0.33 | 0.05 | 0.07 | 0.07 | 0.1 | 0.22 | 0.12 | 0.63 | 0.12 |
| Water, wt. % | 0.03 | 0.06 | 0.03 | 0.01 | 0.07 | 0.05 | 0.59 | 0.11 | 0.001 |
| Carbon Residue, Conrad., wt. % (Rams) | 3.46 | 0.02 | 0.002 | 0.004 | 0.13 | (2.61) | 0.40 | 70.3 | (0.386) |
| Nickel, ppm | <0.1 | <0.5 | <0.5 | 0.7 | <0.5 | <0.2 | <0.5 | 1.0 | <0.2 |
| Molybdenum, ppm | 3 | 0.6 | <0.5 | 23 | 0.7 | <0.5 | 7.4 | 0.3 | <0.5 |
| Vanadium, ppm | <0.1 | <0.5 | <0.5 | 1 | <0.5 | <0.5 | <0.5 | 0.5 | <0.5 |
| Deasphalted Oil | | | | | | | | | |
| Gravity, API | −2.7 | 18.7 | 24.0 | 28.8 | 23.6 | 22.6 | 14.6 | 14.7 | 26.5 |
| Specific Gravity | 1.0983 | .9419 | .9098 | .8829 | .9120 | .9179 | .9684 | .9678 | .8958 |
| Sulfur, wt. % | 0.46 | 0.50 | 0.23 | 0.049 | 0.34 | 2.66 | 0.11 | 2.48 | 0.48 |
| Nitrogen, wt. % | 0.329 | 0.151 | 0.029 | 0.015 | 0.091 | 0.199 | 0.023 | 0.415 | 0.127 |
| Carbon, wt. % | 88.79 | 87.09 | 87.08 | 87.06 | 86.88 | 84.57 | 88.02 | 86.38 | 86.54 |
| Hydrogen, wt. % | 9.74 | 12.00 | 12.42 | 12.73 | 12.35 | 12.25 | 11.62 | 9.75 | 12.70 |
| Oxygen, wt. % | 0.69 | 0.25 | 0.23 | 0.15 | 0.34 | 0.32 | 0.23 | 0.98 | 0.16 |
| Carbon Residue, Rams, wt. % | 2.69 | 0.63 | 0.27 | 0.34 | 0.38 | 2.75 | 1.16 | 0.02 | 0.61 |
| Nickel, ppm | <2.3 | <3.1 | <2.9 | <2.4 | <2.8 | <0.5 | <0.6 | <0.6 | <0.5 |
| Molybdenum, ppm | 3.7 | 5.0 | <2.9 | 1.5 | <2.8 | <0.9 | 4.0 | 1.2 | 1.6 |
| Vanadium, ppm | <2.3 | <3.1 | <2.9 | <2.4 | <2.8 | <0.9 | <1.1 | 1.2 | <1.1 |
| Deasphalted Oil + Heptane | | | | | | | | | |
| Gravity, API | 57.3 | 65.3 | 65.5 | 64.8 | 65.2 | 62.7 | 63.6 | 63.8 | 65.1 |
| Specific Gravity | .7495 | .7190 | .7183 | .7209 | .7194 | .7286 | .7253 | .7245 | .7197 |
| Sulfur, wt. % | 0.10 | 0.08 | <0.04 | <0.04 | 0.06 | 0.59 | <0.04 | 0.43 | 0.09 |
| Nitrogen, wt. % | 0.072 | 0.024 | 0.005 | 0.003 | 0.016 | 0.044 | 0.004 | 0.072 | 0.024 |
| Carbon, wt. % | 85.06 | 84.82 | 84.10 | 84.01 | 84.80 | 85.04 | 84.61 | 84.62 | 84.66 |
| Hydrogen, wt. % | 14.70 | 15.47 | 15.73 | 15.67 | 15.24 | 15.26 | 15.55 | 14.99 | 15.45 |
| Oxygen, wt. % | 0.15 | 0.04 | 0.04 | 0.03 | 0.06 | 0.07 | 0.04 | 0.17 | 0.03 |
| Carbon Residue, Rams, wt. % | 0.589 | 0.10 | 0.047 | 0.07 | 0.067 | 0.61 | 0.204 | 0.003 | 0.116 |
| Nickel, ppm | <0.5 | <0.5 | <0.5 | <0.5 | <0.5 | <0.1 | <0.1 | <0.1 | <0.1 |
| Molybdenum, ppm | 0.8 | 0.8 | <0.5 | 0.3 | <0.5 | <0.2 | 0.7 | 0.2 | 0.3 |
| Vanadium, ppm | <0.5 | <0.5 | <0.5 | <0.5 | <0.5 | <0.2 | <0.2 | 0.2 | <0.2 |
| Solids (Centrifuged) | | | | | | | | | |
| Sulfur, wt. % | 2.33 | 16.74 | 24.71 | 24.78 | 32.75 | 15.4 | 25.20 | 21.2 | 29.0 |
| Carbon, wt. % | 44.59 | 30.74 | 28.23 | 36.12 | 21.68 | 17.97 | 36.76 | 32.86 | 26.91 |
| Hydrogen, wt. % | 5.11 | 3.30 | 3.24 | 4.04 | 2.50 | 1.47 | 4.05 | 3.06 | 2.69 |
| Nitrogen, wt. % | 0.474 | 0.176 | 0.399 | 0.250 | 0.250 | 0.635 | 0.268 | 1.022 | 0.287 |
| Oxygen, wt. % | 8.8 | 2.5 | 4.0 | 2.1 | 2.5 | 9.0 | 2.1 | 5.0 | 2.2 |
| Nickel, wt. % | 0.054 | 0.036 | 0.06 | 0.034 | 0.039 | 0.066 | 0.03 | 0.079 | 0.055 |
| Molybdenum, wt. % | 38.6 | 35 | 31 | 35.1 | 44 | 46 | 31 | 52 | 40 |
| Vanadium, wt. % | 0.046 | 0.050 | 0.07 | 4.5 ppm | 0.053 | 0.068 | 0.02 | 0.079 | 0.069 |

(1,674 v. 861 SCF/B hydrogen consumption, respectively).

Figure 6:
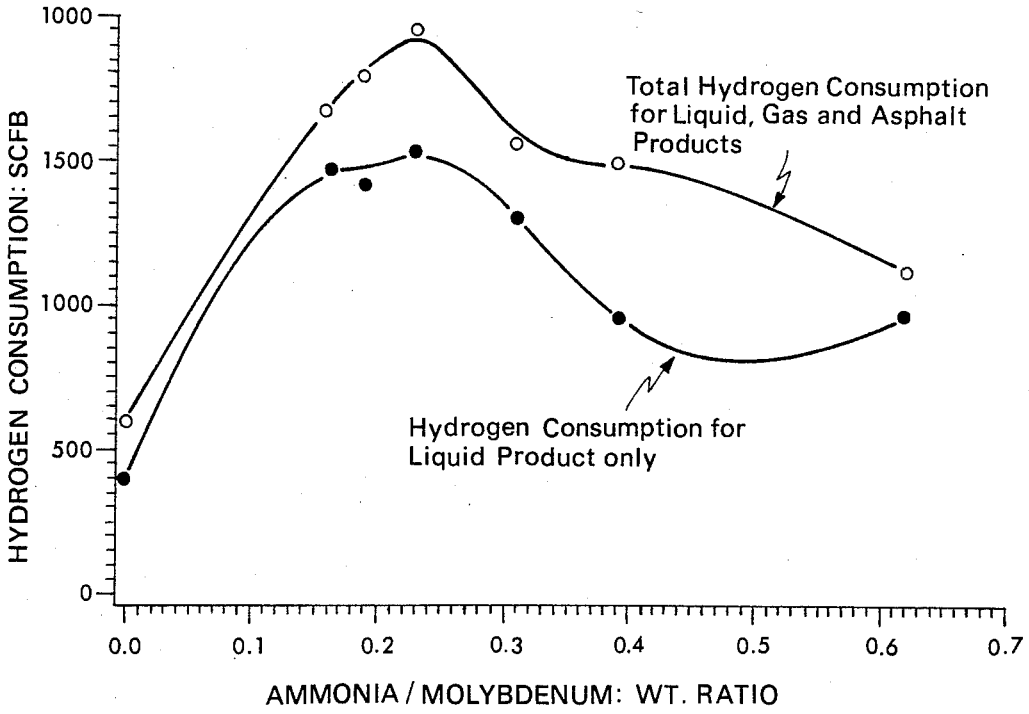

FIG. 6 is based upon the data of Table II and presents a graph showing the effect of the $NH_3$/Mo weight ratio at a constant $H_2S$ to Mo ratio used in preparing the catalysts upon the total hydrogen consumption during the process for liquid, gas and asphalt products, and upon the portion of the total hydrogen consumed which was used specifically to upgrade the oil to $C_5$+ liquid only, i.e. excluding hydrogen used to produce hydrocarbon gases and to convert asphalt. FIG. 6 shows an optimum $NH_3$/Mo ratio in the range of about 0.19 to 0.30.

Figure 7:
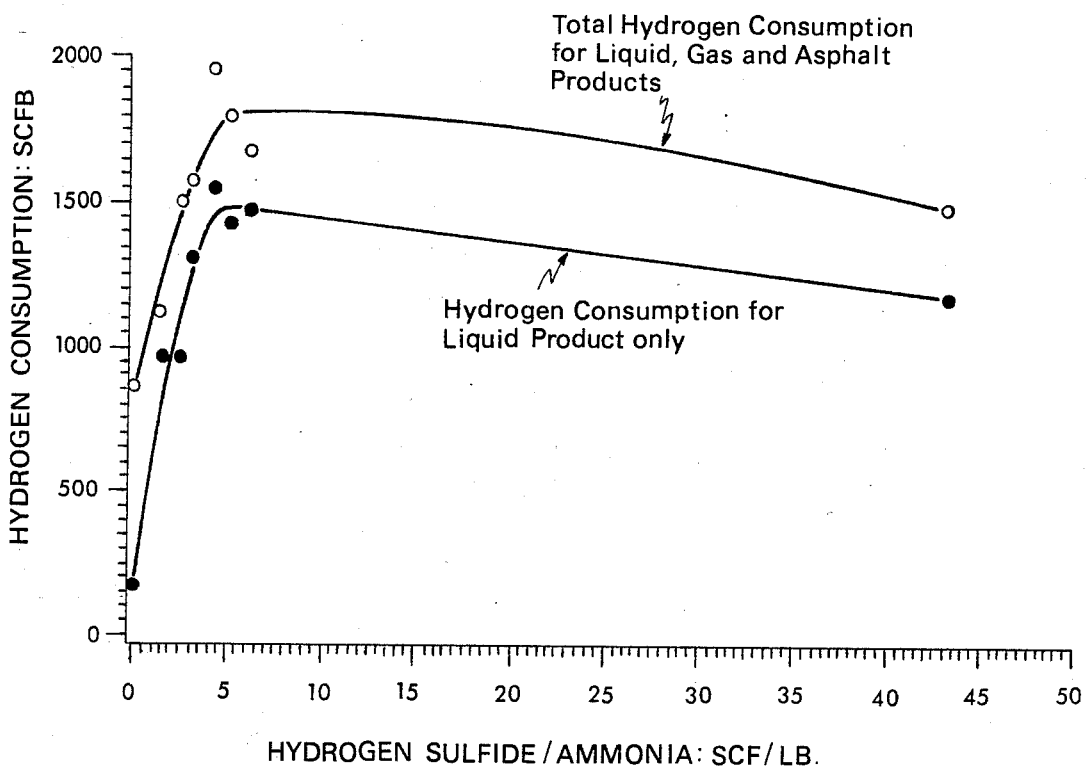

FIG. 7 presents a graph of the total hydrogen consumption for liquid, gas and asphalt products as well as that portion of the total hydrogen consumption used to upgrade the West Texas VTB feedstock to $C_5$+ liquid product only, as contrasted to the production of hydrocarbon gases and conversion of asphalt, as a function of the SCF $H_2S$/# $NH_3$ ratio used in preparing the precursor catalyst, before the catalyst is subjected to high temperature-high pressure sulfiding. FIG. 7 shows that both of these hydrogen consumption values peak at a ratio of SCF $H_2S$/#$NH_3$ near 5, but hydrogen consumption decreases only gradually at ratios above 5. Generally, a ratio higher than 2, 3 or 4 provides good results. Stated in terms of molybdenum, a ratio of 0.5 or greater SCF $H_2S$/# Mo is required.

Figure 8:
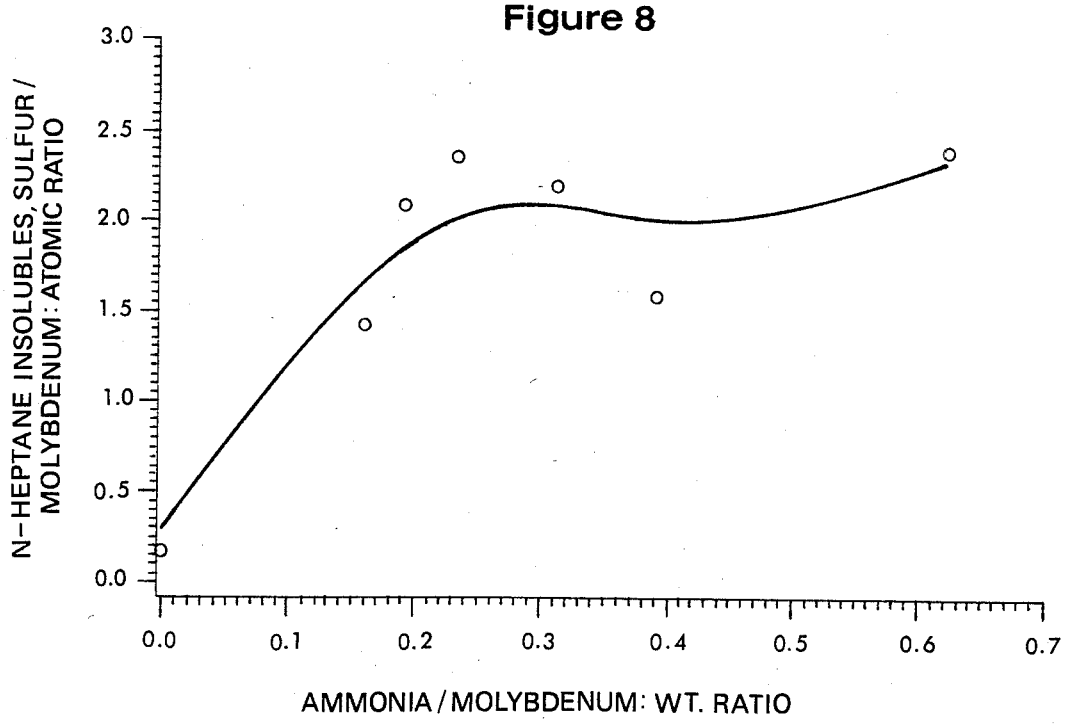

FIG. 8 presents a graph relating the atomic ratio of sulfur to molybdenum in the final catalyst or in the used catalyst (the catalyst as it leaves the oil hydroprocessing reactor) to the weight ratio of $NH_3$/Mo used in preparing the precursor at a constant $H_2S$ to Mo ratio. FIG. 8 shows that $NH_3$/Mo weight ratios higher than about 0.2 must be used to provide a final catalyst S/Mo atomic ratio of at least 2. This clearly shows a relationship between high S/Mo ratio in the final catalyst, high catalyst activity and the $NH_3$/Mo weight ratio used in preparing the precursor catalyst. This also shows that the composition of the final catalyst changes in response to the $NH_3$/Mo weight ratio used in preparing the precursor catalyst.

Figure 9:
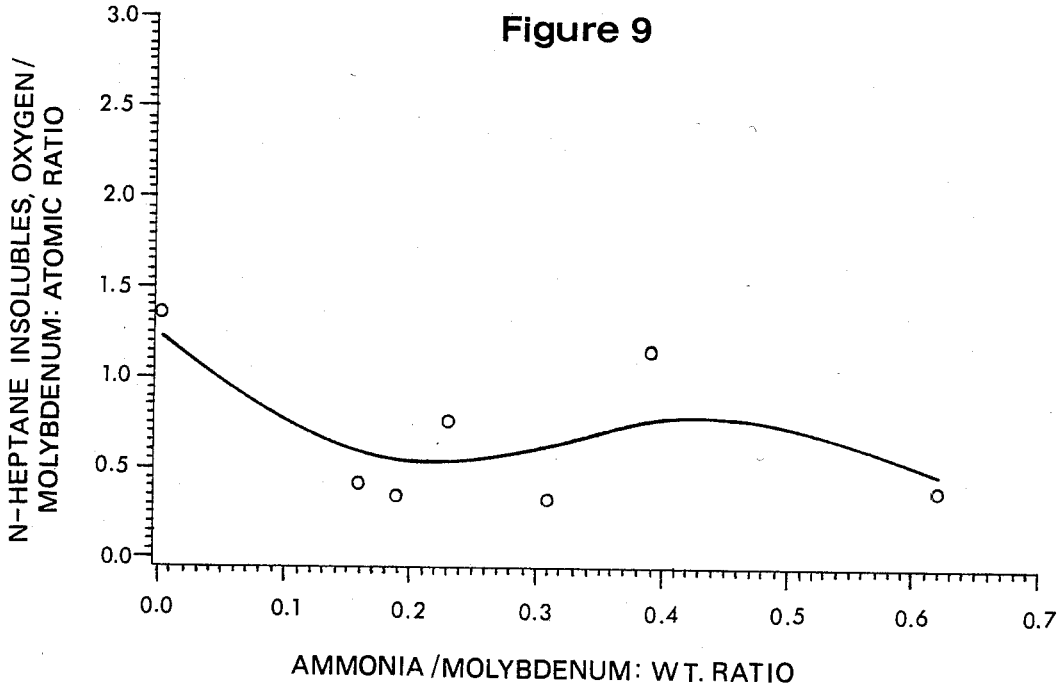

FIG. 9 presents a graph relating to the O/Mo atomic ratio associated with the final catalyst (after the high temperature-high pressure sulfiding stage or after the hydroconversion ractor) to the $NH_3$/Mo weight ratios used in preparing the precursor at a constant $H_2S$/Mo ratio. FIG. 9 shows a minimum O/Mo ratio occurs at or near the same $NH_3$/Mo weight ratio found in FIG. 8 to produce a maximum S/Mo ratio. Apparently, an $NH_3$/Mo ratio between 0.2 and 0.3 is conducive to producing a final catalyst highly capable of attracting sulfur-containing substituents while rejecting oxygen-containing substituents.

The ammonia to molybdenum weight ratios required to produce the highly active catalyst correspond to ratios between those defining the known ammonium octamolybdate and the known ammonium molybdate via reaction of aqueous ammonia with $MoO_3$. The ammonium molybdates which are reported in the literature are:

| | | $NH_3$/Mo Weight Ratio |
|---|---|---|
| Ammonium Molybdate | $(NH_4)_2MoO_4$ | 0.354 |
| Ammonium Dimolybdate | $(NH_4)_2Mo_2O_7$ | 0.178 |
| Ammonium Heptamolybdate (Molybdenum blue) | $(NH_4)_6Mo_7O_{24}.4H_2O$ | 0.158 |
| Ammonium Octamolybdate | $(NH_4)_4Mo_8O_{26}.xH_2O$ (x = 4 or 5) | 0.088 |

The most optimum $NH_3$/Mo weight ratio of 0.23 (generally, 0.19 to 0.27) of this invention is not conducive to producing any of the particular ammonium molybdates of the literature listed above.

Figure 10:
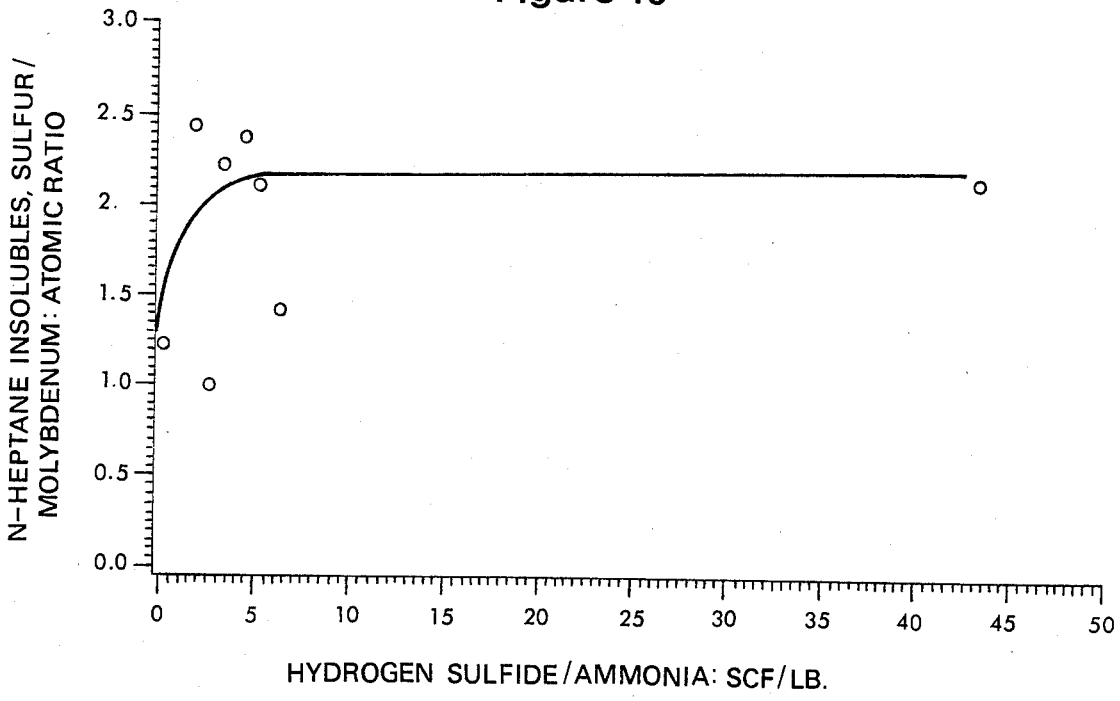

FIG. 10 presents a graph of the S/Mo atomic ratio in the final catalyst (i.e. in the heptane insoluble product fraction) as a function of the $H_2S/NH_3$ (SCF/pound) ratios in preparing the precursor. The lowest $H_2S/NH_3$ ratio data point in FIG. 10 is molybdenum blue, and the highest data point is ammonium (tetra) thiomolybdate. FIG. 10 shows that in order to achieve a S/Mo atomic ratio above 2, at least a 2–5 ratio of $H_2S/NH_3$ is required.

It is seen that by varying $NH_3$/MO ratios and $H_2S/NH_3$ ratios, catalyst composition, catalyst activity, catalyst precursor slurry concentration and catalyst particle size can be controlled. The capability of controlling catalyst particle size and concentration is very important in heavy oil hydroprocessing. This capability allows the production of fine aqueous dispersions of catalyst precursor which can be easily pumped and dispersed into the heavy oil to form heavy oil slurries which also can be easily pumped.

Based on the above findings, following is a preferred catalyst precursor preparation procedure:

1. Dissolve aqueous molybdenum oxide in aqueous ammonium hydroxide solutions under the conditions indicated above.
2. Contact the resulting solution or aqueous slurry with a hydrogen sulfide containing gas stream at pressure and temperature conditions in the same ranges and with the ratio of $H_2S$/Mo indicated above.

The above steps complete the preparation of the precursor catalyst. The final catalyst is then prepared in a subsequent hydrogen-hydrogen sulfide-treating step which occurs by:

3. Agitating the precursor slurry with part or all of the feed oil stream in the presence of an $H_2/H_2S$ stream and sulfiding the catalyst at at least two temperatures at the following conditions:

| | Broad | Preferred | Most Preferred |
|---|---|---|---|
| Pressures, psi: | 500–5000 | 750–2500 | 1250–2000 |
| Temperatures, °F.: (first sulfiding) | 150–350 | 200–300 | 225–275 |
| Temperatures, °F. (second sulfiding) | 351–750 | 525–725 | 600–680 |
| Time, hours (first sulfiding) | 0.05–0.5 | — | — |
| Time, hours (second sulfiding) | 0.05–2 | — | — |

It is noted that the temperature range specified for the first sulfiding need not be confined to one zone and that the temperature range specified for the second sulfiding need not be confined to another zone. The zones can overlap or be merged as long as the specified time durations are observed in heating the reaction stream through the corresponding temperature range.

The product of the above reaction is the final catalyst in slurry with feed oil and water and can be charged to the hydroprocessing reactor without any additions to or removals from the stream, if desired. The final catalyst is ready for entering the heavy oil hydroprocessing reactor and is a highly active, finely dispersed form of molybdenum disulfide. As shown below, it is important for the final catalyst to be prepared at two different temperature levels, both of which are below the temperature in the hydroprocessing reactor.

In the high temperature—high pressure sulfiding operation, $MoO_w$ (w is about 3) is formed and, in turn, decomposes to $MoS_2$. Th stoichiometrics of the equation: $H_2+MoS_3 \rightarrow MoS_2+H_2S$ indicates that $MoS_w$ should break down to the highly active $MoS_2$ catalyst compound without added hydrogen sulfide, but only with $H_2$ as a reducing agent. However, data presented below show that better results are achieved when $H_2S$ as well as $H_2$ is added to the reaction and when the reaction occurs at a temperature below the temperature of the hydroprocessing reaction. Therefore, this reaction is performed in multiple sequential heating zones at temperatures below the temperature of the process reactor.

In addition, data presented below show that the process is improved by $H_2S$ injection into the process reactor itself. Hydrogen sulfiding recycle can replace in whole or in part hydrogen sulfide injection. We have found that the advantage due to $H_2S$ injection into the process reactor is achieved whether or not the catalyst precursors are prepared under the desired conditions of this invention or whether or not a catalyst is utilized at all in the hydroprocessing reactor.

The hydrocarbon feed to the reactor can be a high metals heavy crude, a residual oil, or a refractory distillate fraction such as an FCC decanted oil or a lubricating oil fraction. The feed can also be a coal liquid, shale oil or an oil from tar sands. As stated above, the feed oil contains the aqueous catalyst slurry, hydrogen, and hydrogen sulfide. Following are the process conditions for the hydroprocessing reactor. The general conditions listed apply to both a catalyst and non-catalytic reactor.

| | Broad | Preferred | Most Preferred |
|---|---|---|---|
| Temperature, °F. | 650–1000 | 750–950 | 810–870 |
| Partial Pressures, psi | | | |
| Hydrogen (in reactor) | 350–4500 | 600–2000 | 1100–1800 |
| Hydrogen sulfide (in reactor) | 20–400 | 120–250 | 140–200 |
| Hydrogen sulfide (in recycle stream at process pressure) | at least 20 | at least 50 | at least 100 |
| Oil hourly space velocity LHSV, vol/hr/vol | 0.2–3 | 0.5–2 | 0.75–1.25 |
| Gas Circulation Rates: | | | |
| Hydrogen to Oil Ratio, SCFB | 500–10,000 | 1500–6000 | 2500–4500 |
| Hydrogen Sulfide to Mo, SCF/lb | greater than 5 | greater than 30 | greater than 50 |
| Water to Oil Ratio, wt/wt | 0.005–0.25 | 0.01–0.15 | 0.03–0.1 |
| Cat. to Oil Ratio: | | | |
| Mo to Oil Ratio, wt/wt | 0.0005–0.25 | 0.003–0.05 | 0.005–0.02 |

Table VI presents the results of tests made to illustrate the effect of $H_2S$ and $H_2O$ in the hydroprocessing reactor. A first single test and three sets of tests were performed, each employing FCC decanted oil as a feed stock. No catalyst was employed in the first single test, but catalysts were employed in the three sets of tests. The first test shows that a product API gravity improvement of 3.4 is achieved without a catalyst in the presence of both injected $H_2S$ and water. The first and second sets of tests show higher product API gravity improvements of 9.1 and 10.2, respectively, when a catalyst is also present together with injected $H_2S$ and water. The second set of tests also compares, when using a catalyst, the introduction of both hydrogen sulfide and water into the reactor with the introduction of water without hydrogen sulfide. The introduction of water without hydrogen sulfide resulted in a lower delta API, a lower hydrogen consumption and a lower level of aromatic saturation than is achieved with a catalyst using both $H_2S$ and $H_2O$.

TABLE VI

| | | | | | | | | |
|---|---|---|---|---|---|---|---|---|
| Feedstock | ←FCC Decant Oil→ | | | | | | | |
| Catalyst Precursor | None | ←$(NH_4)xMoOySz$→ | | ←$(NH_4)_2MoS_4$→ | | | ←Commercial $MoS_2$→ | |
| $NH_3$/Mo: weight ratio | — | ←0.16→ | | ← 0.35→ | | | 0.0 | 0.0 |
| $H_2S$/Mo: SCF/# | — | ←1. → | | ←16. → | | | ←8.→ | |
| Screening Conditions | | | | | | | | |
| Pressures | | | | | | | | |
| Hydrogen: psi | | | | ←2150→ | | | | |
| Hydrogen Sulfide: psi | ←181.0→ | | 0. | 182. | 0. | 0. | 171. | 181. |
| Water Vapor: psi | ←254.4→ | | 700. | 390. | 750. | 0. | 0. | 626. |
| Temperature: °F. | | | | | ←700→ | | | |
| Time at Temp.: hrs. | | | | | ← 6→ | | | |
| Cat.-to-Oil Ratio | 0.0 | 0.024 | 0.022 | 0.062 | 0.024 | 0.024 | 0.042 | 0.020 |
| Molybdenum Conversion | | | | | | | | |
| Hydrogen Consumption: SCFB | 450. | 1225. | 186. | 1507. | 560. | −270. | −143. | 222. |
| Product Delta API | 3.4 | 9.1 | 1.8 | 10.2 | 3.5 | −2.1 | −0.1 | 1.2 |
| Aromatic Saturation: % | 14.9 | 42. | 4.8 | 39. | 15. | — | — | −7. |
| Desulfurization: % | 26. | 87. | 29. | 65. | 8.5 | — | — | 27.9 |
| Coke Yield: % | 0.0 | 0.6 | 0.7 | 6.0 | 1.3 | 9.2 | 0.7 | 4.8 |
| Catalyst Sulfur/Metals Ratio Atomic | — | 2.4 | 0.6 | 1.6 | 2.1 | 2.2 | 2.2 | 2.3 |

Referring further to Table VI, the third set of tests employed a commercial $MoS_2$ catalyst which was prepared without using $NH_3$ and therefore is not a catalyst of this invention. The $MoS_2$ catalyst of the prior art did not show any hydrogenation activity when using hydrogen sulfide without water. When water was used together with hydrogen sulfide, it exhibited hydrogenation activity but with a low API gravity improvement and and did not exhibit any aromatic saturation activity. Therefore, the use of hydrogen sulfide is beneficial with a prior art catalyst, but does not elevate the activity of a prior art catalyst to the level of a catalyst of this invention.

In Table VI, comparison of the second test in the first set of tests, using the same catalyst, with the single test, which uses no catalyst, shows that the failure to introduce hydrogen sulfide with a catalyst is more detrimental than the failure to introduce a catalyst with hydrogen sulfide. The absence of hydrogen sulfide when using a catalyst results in a lower hydrogen consumption, a lower delta API and a lower aromatic saturation level. Therefore, it is seen that the introduction of hydrogen sulfide exerts a significant catalytic effect with or without the use of a molybdenum slurry catalyst.

Each of the three tests in the second set of tests of Table VI employed an ammonium thiomolybdate catalyst, $(NH_4)_2MoS_4$, to determine whether high catalyst sulfur content could compensate for $H_2S$ injection into the process. The $(NH_4)_2MoS_4$ is the completely sulfided derivative of ammonium molybdate in which all the oxygen is replaced by sulfur. It is stoichiometrically capable of disassociating in the hydroprocessing reactor to yield $H_2S$ into the reaction system as it is converted to $MoS_2$. The first test of the second set of tests injected both hydrogen sulfide and water together with the catalyst; the second test of the second set injected only water; and the third test injected neither hydrogen sulfide nor water. The second test of the second set exhibited a decline in delta API, aromatic saturation and percent desulfurization as compared to the first, showing that the injection of hydrogen sulfide is necessary to achieve good results even when employing a high sulfur catalyst such as ammonium thiomolybdate which is stoichiometrically capable of breaking down to yield $H_2S$ into the reaction system. It is apparent that the process requires $H_2S$ in much more massive amounts than is available through catalyst decomposition. In fact, it is shown below that an elevated $H_2S$ circulation rate, in addition to a required $H_2S$ partial pressure, is critical to achieving the full benefit of hydrogen sulfide injection. The third test of the second set shows a negative effect in terms of hydrogen consumption and API gravity change when employing an ammonium thiomolybdate catalyst without injection of either water or hydrogen sulfide. The third test of the second set of tests of Table VI shows that an overall detrimental process effect occurs when using the thiomolybdate catalyst without injection of either hydrogen sulfide or water. Clearly, hydrogen sulfide and water each exerts a catalytic effect of its own, as well as cooperatively with each other and with the catalyst.

An extremely interesting observation of the data of the second set of tests of Table VI is that in both tests of the second set of tests wherein no hydrogen sulfide is injected, a form of molybdenum disulfide was formed (S/Mo atomic ratio of at least 2). In the test of the second set of tests wherein hydrogen sulfide and water were both injected, the sulfur to molybdenum ratio was lower than that required to form $MoS_2$. This is unexpected since it would have been expected that the presence of $H_2S$ would have produced the more highly sulfided catalyst. These data show an inherent complexity in the chemical mechanism for forming the final catalyst and indicate that use of an improper catalyst precursor and/or improper conditions of sulfiding cannot lead to the production of the highly active final form of molybdenum disulfide of this invention, even though the chemical formula of the less active final catalyst closely approximates $MoS_2$.

Table VII shows a set of tests illustrating the effect of hydrogen sulfide and water injection on the visbreaking of a Maya (high metals heavy Mexican crude) ATB feedstock. These tests were made without a catalyst. The first test of Table VII was made with injection of both hydrogen sulfide and water vapor and the second with water vapor only. Table VII shows that the failure to inject hydrogen sulfide reduced hydrogen consumption, and greatly increased coke yield. The data of Table VII demonstrate the catalytic effect of injection of hydrogen sulfide, even without a molybdenum catalyst.

TABLE VII

| | | | |
|---|---|---|---|
| Feedstock | ← | Maya ATB | → |
| Reaction Conditions | | | |
| Reactor Pressure, psig | ← | 2500. | → |
| Gas Circ.: SCFB | ← | 600. | → |
| Rates | | | |
| Hydrogen: SCFB | 940.9 | 874.9 | 1387.1 |
| Hydrogen Sulfide: SCFB | 75.3 | 0.0 | 110.9 |
| Water-to-Oil Ratio: #/# | 0.31 | 0.34 | 0.0 |
| Reactor Temperature: °F. | ← | 750.0 | → |
| Time at Temperature: hrs. | ← | 2.0 | → |
| Cat/Oil Ratio | ← | 0.0 | → |
| Yields | | | |
| Hydrogen Sulfide: wt. % | 1.1 | 2.7 | 1.5 |
| Liquid Oil Product: vol. % | 84.6 | 22.5 | 74.5 |
| Deasphalted Oil: vol. % | 13.7 | 61.3 | 15.5 |
| Coke: wt. % | 3.62 | 18.74 | 13.15 |
| Quality | | | |
| Liquid Oil Product: API | 13.1 | 12.9 | 21.0 |
| Deasphalted Oil: API | 25.9 | 21.2 | 4.6 |
| Coke: (H/C Atomic) | 0.94 | 1.23 | 0.87 |
| Conversion | | | |
| Liquid Recovery | 100.0 | 85.3 | 90.6 |
| Hydrogen Consumption: SCFB | 521. | 466. | −8. |
| % Desulfurization | 30.5 | 74.8 | 46.5 |
| % Demetalation | 47.6 | 93.9 | 88.4 |

Figure 11:
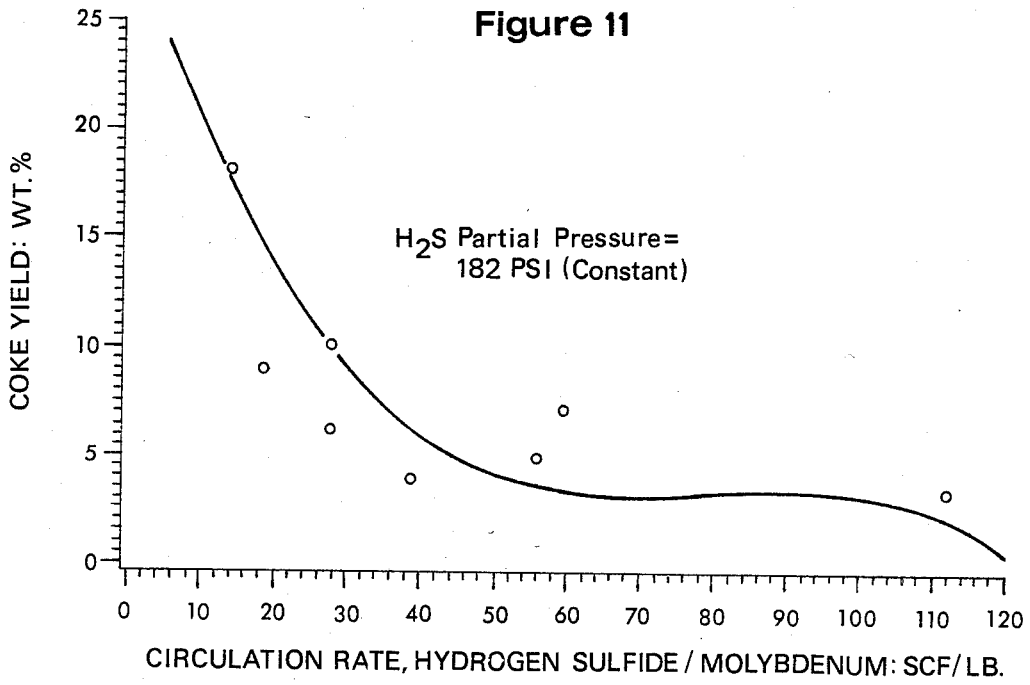

Not only is the presence of hydrogen sulfide critical, but its circulation rate is also critical. FIG. 11 shows a remarkable effect on coke yield with an FCC decanted feed oil is achieved by varying $H_2S$ circulation rate in a molybdenum catalyst system while holding the $H_2S$ partial pressure constant at 182 psi. FIG. 11 shows that increasing the hydrogen sulfide circulation rate from about 10 or 15 to over 60 SCF $H_2S$/#Mo at a constant $H_2S$ partial pressure reduced the coke yield from nearly 20 weight percent to less than 5 weight percent. This $H_2S$ circulation rate is advantageously achieved by recycling around the hydroprocessing reaction an $H_2/H_2S$ stream comprising the required amount of $H_2S$. This amount of $H_2S$ in the hydrogen recycle stream is required whether the hydroprocess is catalytic or non-catalytic.

The liquid product obtained in the three tests of Table VII was decanted to form a clear decanted oil ($C_5$ to about 1075° F.) and sludge. The sludge was extracted with heptane to form a heptane soluble fraction and a heptane insoluble fraction. The heptane insoluble fraction is a coke precursor.

As stated above, the first test of Table VII employed both hydrogen sulfide and water vapor. The second test of Table VII which employed water vapor without hydrogen sulfide shows the highest heptane insoluble yield (18.74% wt.) and the highest H/C ratio in the heptane insolubles (1.23). Heptane insolubles (asphaltenes) are coke precursors and a high yield shows a relative lack of hydrocracking of this high boiling, undesirable liquid, to the desired liquid product (decanted oil plus heptane solubles). The absence of hydrogen sulfide in the second test indicates that the lack of hydrocracking was due to the lack of this acidic constituent from the system, since acidic materials are known to impart hydrocracking activity. The high H/C ratio in these asphaltenic heptane insolubles of the second experiment indicates a relatively high hydrogenation activity in the system due to the water vapor. However, the high level of these asphaltenes (18.79 weight percent) in the product of the second test shows a lack of cracking activity to convert these high H/C ratio asphaltenes due to the absence of hydrogen sulfide.

The third test of Table VII utilized hydrogen sulfide injection but not water vapor. The third test produced a lower heptane insolubles (asphaltenes) yield than the second test, indicating the injection of hydrogen sulfide imparted hydrocracking activity. However, the asphaltenes of the third test exhibited a lower asphaltenic H/C ratio than the asphaltenes of the second test, indicating that the absence of water reduced the hydrogenation activity of the system.

The first test of Table VII utilized both hydrogen sulfide and water injection. The first test exhibits by far the lowest heptane insolubles (asphaltenes) yield (3.62 weight percent) of the three tests, but not the lowest H/C ratio in the asphaltenes. This tends to indicate that the injected hydrogen sulfide and water vapor operate interdependently in an unusual matter. First, the hydrogen sulfide in the presence of water induced more asphaltic hydrocracking than the use of hydrogen sulfide alone (compare with the third test—3.62 weight percent asphaltenes v. 13.15 weight percent). Secondly, the water in the presence of hydrogen sulfide imparted a lower hydrogen level to the asphaltenes than the use of water alone (compare with the second test—asphaltenic H/C ratio of 0.94 v. 1.23). Finally, it is ususual that the high hydrocracking activity of the first test (3.62 weight percent heptane insolubles yield) would be accompanied by a relatively low H/C ratio in these asphaltenes (0.94), since a low H/C ratio in asphaltenes indicates a high tendency towards coking, rather than hydrocracking. Therefore, the first test of Table VII indicates that injection of both hydrogen sulfide and water imparts an improved hydrocracking activity in spite of only moderate hydrogenation activity, and the hydrocracking activity is remarkably greater than is achieved by injection of one of these materials in the absence of the other.

Figure 12:
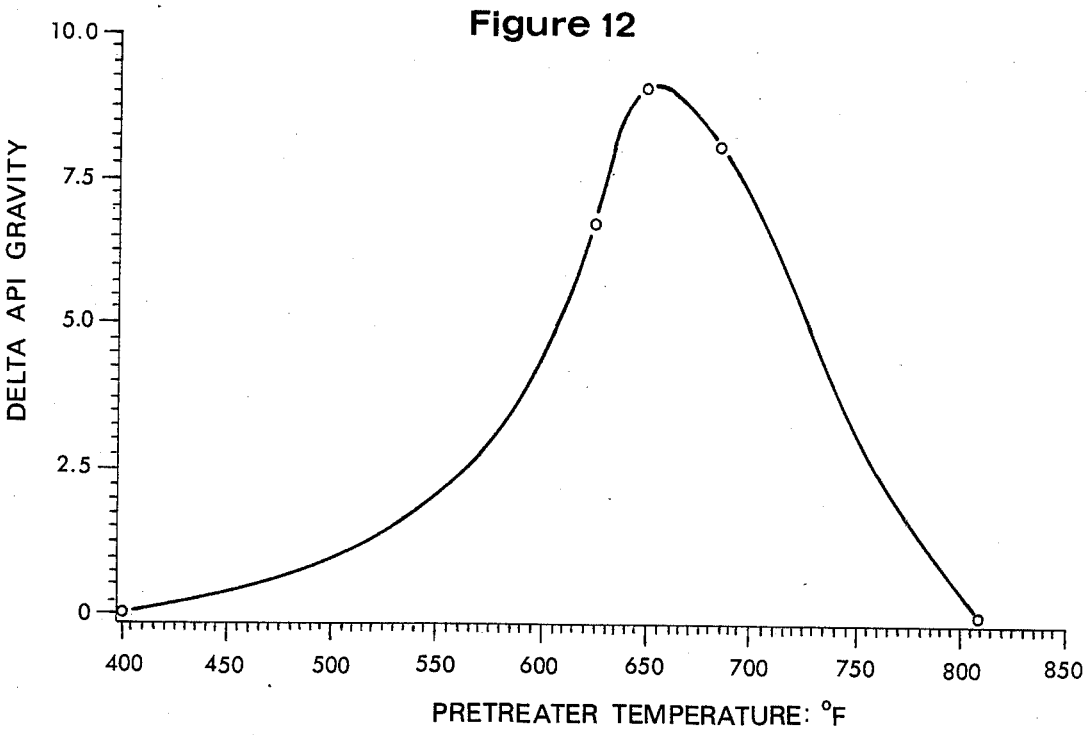

Returning now to the catalytic mode of the present invention, FIG. 12 illustrates a highly critical feature in the upgrading of the precursor catalyst to the final catalyst of this invention prior to the hydroprocessing reactor. As stated above, the aqueous precursor ammonium molybdenum oxysulfide is mixed with feed oil and further sulfided with hydrogen sulfide to produce a final catalyst which is introduced into the hydrocarbon conversion reactor. The temperature in the hydrocarbon conversion reactor is always sufficiently high for water to be present wholly or partially in the vapor phase. FIG. 12 relates API gravity improvement in the oil being hydrogenated to the highest temperature of the catalyst sulfiding operation in advance of the hydroprocessing reactor. FIG. 12 shows that the greatest improvement in API gravity occurs when the catalyst precursor is sulfided with $H_2S$ at a temperature of about 660° F., which is well below the temperature at which the catalyst is used for hydroprocessing. The data in FIG. 12 show the criticality of employing a heated pretreater zone to treat the precursor catalyst with $H_2S$ in advance of the process reactor. The precursor catalyst employed for the data of FIG. 12 was prepared using an $NH_3$/Mo weight ratio of 0.23, and an $H_2S$/Mo ratio of 2.7 SCF/lb Mo (catalyst number 7 of Table I). The precursor catalyst prepared in this manner was thereupon sulfided under the temperature conditions shown in FIG. 12 and was used in a hydroprocessing reactor at a concentration of 1.3 weight percent of Mo to oil. The oil which was hydroprocessed was West Texas VTB.

The 660° F. optimum catalyst sulfiding temperature of FIG. 12 is below the critical temperature of water (705° F.). Therefore, at least a portion of the water which is present in the catalyst sulfiding reactor is in the liquid phase. While the catalyst is sulfided at this temperature, we have found that this temperature is too low for any significant conversion of a crude oil or a residual oil feedstock. For example, we have found that a Maya ATB or VTB feedstock in the presence of a molybdenum slurry catalyst at a pressure of 2500 psi and at temperatures of 716° and 800° F. undergoes the following conversion levels:

| | Desulfurization | Demetalation | API Gravity Improvement |
|---|---|---|---|
| 716° F. | 13.9% | 28.3% | 4 |
| 800° F. | 78% | 99.5% | 28 |

These data show that at a temperature of 716° F., which is even higher than the optimum catalyst sulfiding temperature shown in FIG. 12, conversion levels are relatively insignificant compared to potential conversion levels at the relatively moderately higher temperature of 810° F. It is noted that when hydroprocessing a refractory distillate oil, such as an FCC decanted oil or a lubricating oil fraction, much lower hydroprocessing temperatures, e.g. about 700° F., are effective.

Figure 13:
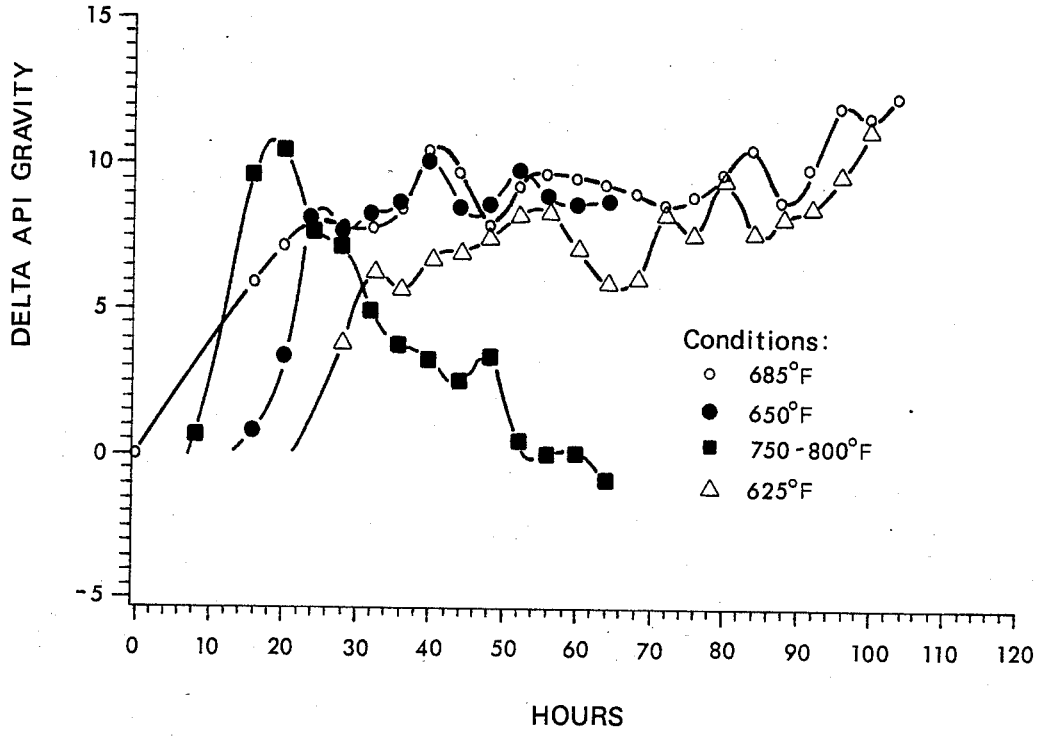

FIG. 13 illustrates the effect of catalyst sulfiding temperature upon catalyst activity in a hydroprocessing operation performed at 810° F. FIG. 13 relates delta API gravity (gain or loss) in the oil undergoing hydroprocessing to the sulfiding temperature used for preparing the final catalyst, for four different sulfiding temperatures. The highest sulfiding temperature test of 750°-800° F. indicates that no low temperature pretreater was employed but that in fact sulfiding occurred in the hydroprocessing reactor itself or substantially under the conditions of the reactor. This test exhibited the most favorable results in terms of delta API gravity of all the tests after about 15 hours of continuous operation. However, with increasing run time the initially high improvement in API gravity declined rapidly, and after about 60 hours this test actually resulted in a loss in API gravity during hydroprocessing. In contrast, the other three tests of FIG. 13 employed lower catalyst sulfiding temperatures of 625° F., 650° F. and 685° F., respectively, all below the temperature of the oil hydroprocessing reactor, which was 810° F. Although these lower sulfiding temperatures induced a relatively small improvement in the API gravity in the product oil after 15 hours, these lower sulfiding temperatures resulted in a catalyst which improved with run duration to ultimately achieve a stable API gravity improvement.

The mode of sulfiding of the catalyst precursor to produce a final catalyst is highly critical to catalyst activity. The mode of sulfiding, rather than the amount of sulfur on the catalyst, determines the activity of the catalyst. For example, ammonium thiomolybdate, $(NH_4)_2MoS_4$, has the highest sulfur content of any sulfided ammonium molybdate and contains adequate sulfur to be converted to $MoS_2$ upon heating without added hydrogen sulfide. However, the $MoS_2$ derived from this source is relatively inactive. Furthermore, any $MoS_2$ formed with added hydrogen sulfide injected into an aqueous ammonium salt precursor but without an added oil phase has been found to be relatively inactive. It has been found that commercial $MoS_2$ is relatively inactive. Therefore, the catalyst of the present invention cannot be defined solely by its composition. It must be defined by its mode of preparation. We have found that the most active slurry catalyst of this invention must be sulfided in the presence of not only $H_2S$ and an aqueous sulfided ammonium molybdate salt but also in the presence of an oil phase, preferably the process feed oil. The mixture is preferably dispersed with a mechanical mixer. The oil may serve in some way to affect the contact between the reactants. At the temperature of the sulfiding step the water is in the liquid phase, so that there is a liquid water and an oil phase both present as well as a gaseous hydrogen sulfide phase, including hydrogen, all present and highly intermixed during the sulfiding operation. In this manner, a highly active final molybdenum sulfide slurry catalyst is produced.

Since vanadium in relatively high quantity, e.g. up to 1,000 ppm, or even 2,000 ppm, or more, is present in crude and residual oils, a recycled molybdenum catalyst of this invention will contain or be intermingled with vanadium accumulated from the processing of such crude or residual oils. Therefore, the recycled catalyst, after recovery and oxidation stages, will comprise a combination of molybdenum and vanadium oxides. Tests were made to determine the activity of a catalyst comprising a mixture of vanadium and molybdic oxides. Tests were also performed to determine the activity of vanadium pentoxide, $V_2O_5$, as a slurry catalyst in its own right.

It was found that recycled molybdenum catalyst can comprise up to about 70–85 weight percent vanadium (based on total atomic metals) and still constitute an active catalyst, as long as the recycled catalyst is reacted with the optimum amount of ammonia required to react with the molybdenum which is present, disregarding any metals present other than molybdenum. We have found that the optimum ammonia-to-molybdenum ratio is unchanged by the presence of the vanadium.

We have found that $V_2O_5$ when substituted for $MoO_3$ and subjected to the same preparation procedure as is used for $MoO_3$ does not provide an active catalyst. It is believed that vanadium sulfide precursors are not formed in the regeneration procedure because the optimum amounts of ammonia required to bring molybdenum into solution will not bring vanadium into solution. In tests with a considerable excess of ammonia, vanadium sulfide was probably produced. However, the vanadium sulfide gave a higher coke yield while consuming less hydrogen than unsulfided vanadium. Therefore, vanadium sulfide by itself is not an active catalyst. Because of this observation, it is quite surprising that a composite containing up to 70, 75, 80 or 85 weight percent vanadium with molybdenum (based on total atomic metals) can be recycled and regenerated in a manner so that it is not significantly less active than molybdenum alone.

Tests were performed to directly determine the effect of vanadium on a molybdenum sulfide slurry catalyst of this invention. Varying amounts of molybdic oxide and vanadium pentoxide were added to a constant amount of water to form a number of aqueous slurries. A constant amount of ammonia solution was added to and mixed with each of these slurries. The total metals concentration and the total weight of the mixtures were kept constant. Table VIII summarizes the amounts and concentrations of the components as well as ammonia-to-molybdenum ratios and the percentages of individual metals.

TABLE VIII

| Catalyst Number | 1 | 2 | 3 | 4 | 5 | 6 | 7 | 8 |
|---|---|---|---|---|---|---|---|---|
| Catalyst Solution: gms | | | | | | | | |
| Molybdic Oxide | 0.0 | 18.0 | 36.0 | 48.0 | 54.0 | 48.0 | 48.0 | 0.0 |
| Vanadium Pentoxide | 96.0 | 54.0 | 36.0 | 20.0 | 18.0 | 8.0 | 0.0 | 96.0 |
| $NH_4OH$ (29.2% as $NH_3$) | 34.4 | 25.8 | 25.8 | 25.0 | 25.8 | 20.6 | 34.4 | 34.4 |
| Distilled Water | 289.1 | 124.3 | 124.3 | 103.9 | 124.3 | 85.6 | 82.8 | 289.1 |
| Total | 419.5 | 222.1 | 222.1 | 196.9 | 222.1 | 162.2 | 165.2 | 419.5 |
| Percent by Weight | | | | | | | | |
| Molybdic Oxide | 0.00 | 8.10 | 16.21 | 24.38 | 24.31 | 29.60 | 29.06 | 0.00 |
| Vanadium Pentoxide | 22.88 | 24.31 | 16.21 | 10.16 | 8.10 | 4.93 | 0.00 | 22.80 |
| $NH_3$ | 2.39 | 3.39 | 3.39 | 3.70 | 3.39 | 3.71 | 6.08 | 8.20 |
| Distilled Water | 74.73 | 64.20 | 64.19 | 62.76 | 64.20 | 61.76 | 64.86 | 68.90 |
| Total | 100.00 | 100.00 | 100.00 | 100.00 | 100.00 | 100.00 | 100.00 | 100.00 |
| Wt. % Mo in Solution | 0.0 | 5.4 | 10.8 | 16.2 | 16.2 | 19.7 | 10.8 | 0.0 |
| Wt. % V in Solution | 12.8 | 13.6 | 9.1 | 5.7 | 4.5 | 2.8 | 0.0 | 12.8 |
| Wt. % $NH_3$ in Solution | 2.4 | 3.4 | 3.4 | 3.7 | 3.4 | 3.7 | 10.8 | 2.4 |
| Wt. Ratio | | | | | | | | |
| $NH_3$/Mo | — | .6296 | .3148 | .2284 | .2098 | .1878 | .3123 | — |
| $NH_3$/V | .1875 | .2500 | .3736 | .6491 | .7555 | 1.321 | — | .1875 |
| $NH_3$/Metals | .1875 | .1789 | .1708 | .1689 | .1643 | .1644 | .3123 | .1875 |
| Charged to Autoclave: gms | 150.0 | 88.3 | 84.5 | 103.5 | 81.0 | 85.5 | 78.0 | 150.0 |
| Cat/Oil Ratio | .048 | .042 | .044 | .056 | .042 | .048 | .018 | .025 |

The resulting slurries were stirred and heated to 150° F. at atmospheric pressure. This temperature was maintained for 2 hours. Thereupon, a flow of hydrogen sulfide-containing gas (92 percent hydrogen—8 percent hydrogen sulfide) was introduced until 1 SCF of hydrogen sulfide was contacted per pound of total metals at an $H_2S$ partial pressure of 3.2 psi.

Each catalyst listed in Table VIII was tested in an autoclave for the hydroprocessing of a Maya ATB feedstock. The inspections of this feedstock are shown in Table IX.

TABLE IX

| Inspections | Maya ATB |
|---|---|
| Gravity: API | 7.5 |
| Specific Gravity | 1.0180 |
| Viscosity, SUS, D2161: | |
| 210° F. | 1903. |
| 250° F. | 648. |
| Pour Point: °F. | 0. |
| Sulfur: wt. % | 4.74 |
| Hydrogen: wt. % | 10.23 |
| Nitrogen: wt. % | 0.53 |
| Oxygen: wppm | 2960. |
| Water: wppm | 274. |
| Metals: wppm | 438. |
| Nickel: wppm | 75. |
| Vanadium: wppm | 408. |
| Carbon: wt. % | 83.91 |
| Carbon Residue, Con.: wt. % | 18.0 |
| Distillation, Vac.: °F. | |

TABLE IX-continued

| Inspections | Maya ATB |
|---|---|
| 5% @ | 703 |
| 10% @ | 756 |
| 20% @ | 820 |
| 30% @ | 884 |
| 40% @ | 931 Cracked |

The test autoclave was operated by circulating a hydrogen/hydrogen sulfide gas without any other circulating material through the filled autoclave while heating the autoclave under the following sulfiding conditions:

First Sulfiding

Temperature, 350° F.; Time, 0.1 hours.

Second sulfiding

Temperature, 680° F.; Time, 0.5 hours.

Table X presents the test conditions and a summary of the results obtained from screening the catalysts listed in Table VIII.

A fuller set of product inspections and product yields derived from the data of Table X is presented in Table XI.

TABLE X

| | |
|---|---|
| Feedstock: | Maya ATB |
| Reaction Conditions | |
| Temperature, °F.: | 818. |
| Pressure, psig: | 2500. |
| Hydrogen, SCFB: | 5149. |
| $H_2S$, SCF/lb of Cat: | 30.5 |
| Time at Temp., hrs: | 2. |

| Catalyst Number | 1 | 2 | 3 | 4 | 5 | 6 | 8 | 9 | 10 |
|---|---|---|---|---|---|---|---|---|---|
| Cat/Oil Ratio | 0.048 | 0.042 | 0.044 | 0.056 | 0.042 | 0.048 | 0.025 | 0.042 | 0.042 |
| Molybdenum | 0.0 | 0.012 | 0.025 | 0.042 | 0.053 | 0.042 | 0.00 | 0.012 | 0.042 |
| Vanadium | 0.048 | 0.030 | 0.019 | 0.015 | 0.009 | 0.006 | 0.025 | 0.030 | 0.00 |
| Yields | | | | | | | | | |
| $H_2$ Consumption: SCFB | 684 | 1431 | 1537 | 1726 | 1527 | 1360 | 599 | 1052 | 1243 |
| $H_2S$: wt. % | 1.84 | 4.74 | 4.86 | 4.84 | 4.97 | 4.46 | 4.46 | 2.95 | 4.23 |
| $C_6$ & Lighter: vol. % | 12.03 | 8.0 | 5.5 | 5.0 | 12.2 | 9.2 | 8.7 | 4.7 | 4.5 |
| Liquid Oil Product: vol. % | 84.3 | 81.8 | 76.6 | 90.1 | 77.3 | 84.4 | 86.0 | 95.0 | 92.9 |
| Deasphalted Oil: vol. % | 10.2 | 18.7 | 27.3 | 18.6 | 21.4 | 15.2 | 4.7 | 8.1 | 10.9 |
| Asphalt: wt. %(1) | 2.7 | 4.3 | 3.5 | 2.4 | 3.4 | 2.7 | 12.3 | 1.9 | 2.1 |
| Conversion | | | | | | | | | |
| Delta API | 24.1 | 29.2 | 28.3 | 31.3 | 30.9 | 27.2 | 24.7 | 21.2 | 22.7 |
| % Desulfurization | 47.5 | 94.1 | 96.5 | 96.0 | 98.6 | 88.5 | 61.9 | 58.6 | 84.1 |
| % Demetalation | 96.3 | 99.8 | 98.6 | 99.8 | 98.6 | 99.8 | 98.8 | 98.6 | 99.9 |

(1)n-Heptane insolubles from decanted sludge products.

TABLE XI (A)

| Catalyst Number: | 1 | | 2 | | 3 | | 4 | | 5 | | 6 | | 8 | | 9 | | 10 | |
|---|---|---|---|---|---|---|---|---|---|---|---|---|---|---|---|---|---|---|
| Reaction Conditions | | | | | | | | | | | | | | | | | | |
| Reactor Pressure: psig | 2500.0 | | 2500.0 | | 2500.0 | | 2500.0 | | 2500.0 | | 2500.0 | | 2500.0 | | 2500.0 | | 2500.0 | |
| Rates: | | | | | | | | | | | | | | | | | | |
| Gas Circ: SFC/Bbl | | 615.5 | | 626.1 | | 633.7 | | 617.2 | | 614.9 | | 617.5 | | 621.9 | | 635.7 | | 621.8 |
| Hydrogen: SCF/Bbl | | 4395.8 | | 6263.5 | | 4949.5 | | 6033.7 | | 5605.6 | | 4532.2 | | 5633.6 | | 3665.2 | | 5261.3 |
| $H_2S$: SCF/Lb. (Cat.) | | 22.5 | | 36.3 | | 27.6 | | 26.1 | | 32.8 | | 23.0 | | 54.3 | | 21.3 | | 30.7 |
| Reactor Temp.: °F. | 814.0 | | 815.0 | | 820.0 | | 816.0 | | 817.0 | | 828.0 | | 821.0 | | 816.0 | | 819.0 | |
| Time at Temp.: Hrs. | 2.0 | | 2.0 | | 2.0 | | 2.0 | | 2.0 | | 2.0 | | 2.0 | | 2.0 | | 2.0 | |
| Cat/Oil Ratio | 0.048 | | 0.042 | | 0.044 | | 0.056 | | 0.042 | | 0.048 | | 0.025 | | 0.042 | | 0.042 | |
| Molybdenum | | 0.0 | | 0.012 | | 0.025 | | 0.042 | | 0.033 | | 0.042 | | 0.0 | | 0.012 | | 0.042 |
| Vanadium | | | | 0.030 | | 0.019 | | 0.015 | | 0.009 | | 0.006 | | 0.025 | | 0.030 | | |
| Weight Balance | 105.28 | | 97.09 | | 91.93 | | 94.18 | | 104.79 | | 102.35 | | 87.32 | | 96.50 | | 97.18 | |
| Yields: % | Wt. | Vol. | Wt. | Vol. | Wt. | Vol. | Wt. | Vol. | Wt. | Vol. | Wt. | Vol. | Wt. | Vol. | Wt. | Vol. | Wt. | |
| Hydrogen | −1.02 | | −2.12 | | −2.27 | | −2.55 | | −2.26 | | −2.01 | | −0.89 | | −1.56 | | −1.84 | |
| Hydrogen Sulfide | 1.84 | | 4.74 | | 4.86 | | 4.84 | | 4.97 | | 4.46 | | 3.13 | | 2.95 | | 4.23 | |
| Ammonia | 0.13 | | 0.59 | | 0.62 | | 0.62 | | 0.59 | | 0.45 | | 0.36 | | 0.30 | | 0.36 | |
| Refinery Gas | | | | | | | | | | | | | | | | | | |
| Methane | 0.71 | | 0.32 | | 0.43 | | 0.26 | | 0.27 | | 0.57 | | 1.05 | | 0.82 | | 0.38 | |
| Ethane | 4.24 | | 2.40 | | 2.00 | | 1.72 | | 2.38 | | 2.82 | | 2.37 | | 2.20 | | 1.65 | |
| Ethylene | 0.19 | | 0.0 | | 0.0 | | 0.0 | | 0.0 | | 0.0 | | 0.01 | | 0.0 | | 0.0 | |
| Propanes | | | | | | | | | | | | | | | | | | |
| Propane | 4.41 | 8.8 | 2.56 | 5.1 | 1.64 | 3.3 | 1.53 | 3.1 | 3.43 | 6.9 | 2.53 | 5.1 | 1.83 | 3.7 | 1.58 | 3.2 | 1.44 | 2.9 |
| Propylenes | 0.35 | 0.7 | 0.0 | 0.0 | 0.0 | 0.0 | 0.0 | 0.0 | 0.0 | 0.0 | 0.0 | 0.0 | 0.0 | 0.2 | 0.0 | 0.0 | 0.0 | 0.0 |
| Butanes | | | | | | | | | | | | | | | | | | |
| I—Butane | 0.78 | 1.4 | 0.31 | 0.6 | 0.22 | 0.4 | 0.22 | 0.4 | 0.51 | 0.9 | 0.40 | 0.7 | 0.20 | 0.4 | 0.26 | 0.5 | 0.18 | 0.3 |
| N—Butane | 2.18 | 3.8 | 1.00 | 1.7 | 0.62 | 1.1 | 0.55 | 1.0 | 1.71 | 3.0 | 1.07 | 1.9 | 0.51 | 0.9 | 0.55 | 1.0 | 0.45 | 0.8 |
| Butanes | 0.0 | 0.0 | 0.0 | 0.0 | 0.01 | 0.0 | 0.00 | 0.0 | 0.0 | 0.0 | 0.01 | 0.0 | 0.04 | 0.1 | 0.0 | 0.0 | 0.02 | 0.0 |
| Pentanes | | | | | | | | | | | | | | | | | | |
| I—Pentane | 0.0 | 0.0 | 0.18 | 0.3 | 0.14 | 0.2 | 0.12 | 0.2 | 0.34 | 0.6 | 0.29 | 0.5 | 0.9 | 0.1 | 0.0 | 0.0 | 0.10 | 0.2 |
| N—Pentane | 0.0 | 0.0 | 0.21 | 0.3 | 0.16 | 0.3 | 0.11 | 0.2 | 0.47 | 0.8 | 0.32 | 0.5 | 0.11 | 0.2 | 0.0 | 0.0 | 0.09 | 0.1 |
| Pentenes | 0.0 | 0.0 | 0.0 | 0.0 | 0.00 | 0.0 | 0.00 | 0.0 | 0.0 | 0.0 | 0.01 | 0.0 | 0.0 | 0.0 | 0.0 | 0.0 | 0.1 | 0.0 |
| Hexanes + | 0.0 | 0.0 | 0.0 | 0.0 | 0.10 | 0.2 | 0.5 | 0.1 | 0.0 | 0.0 | 0.32 | 0.05 | 0.0 | 0.0 | 0.0 | 0.0 | 0.13 | 0.2 |
| Liquid Oil Product | 73.09 | 82.3 | 68.46 | 81.8 | 63.46 | 76.6 | 73.80 | 90.1 | 64.72 | 77.3 | 71.84 | 84.4 | 73.38 | 86.0 | 83.52 | 95.0 | 80.69 | 92.9 |
| Deasphalted Oil | 10.43 | 10.0 | 17.05 | 18.7 | 24.45 | 27.3 | 16.31 | 18.6 | 19.47 | 21.4 | 14.19 | 15.2 | 5.36 | 4.7 | 7.49 | 8.1 | 10.02 | 10.9 |
| Asphalt | 2.67 | | 4.30 | | 3.55 | | 2.43 | | 3.40 | | 2.72 | | 12.38 | | 1.89 | | 2.09 | |
| Total | 100.00 | 106.9 | 100.00 | 108.6 | 100.00 | 109.3 | 100.00 | 113.5 | 100.00 | 110.8 | 100.00 | 108.8 | 100.00 | 96.1 | 100.00 | 107.7 | 100.00 | 108.3 |
| Slurry/Oil Ratio | 0.0609 | | 0.0721 | | 0.0713 | | 0.0543 | | 0.0457 | | 0.0242 | | 0.0268 | | 0.0378 | | 0.0332 | |
| Sulfur | | 0.0012 | | 0.0103 | | 0.0227 | | 0.0136 | | 0.0185 | | 0.0093 | | 0.0067 | | 0.0054 | | 0.0058 |
| Nickel | | 0.0 | | 0.0001 | | 0.0001 | | 0.0001 | | 0.0001 | | 0.0001 | | 0.0001 | | 0.0001 | | 0.0001 |
| Molybdenum | | 0.0403 | | 0.0112 | | 0.0192 | | 0.0228 | | 0.0183 | | 0.0098 | | 0.0001 | | 0.0042 | | 0.0119 |
| Iron | | | | 0.0 | | 0.0 | | 0.0 | | 0.0 | | 0.0 | | 0.0 | | 0.0 | | 0.0 |
| Vanadium | | | | 0.0242 | | 0.0160 | | 0.0079 | | 0.0040 | | 0.0014 | | 0.0128 | | 0.0170 | | 0.0003 |
| Conversion: | | | | | | | | | | | | | | | | | | |
| Hydrogen Consumption: SCFB | 684. | | 1431. | | 1537. | | 1726. | | 1527. | | 1360. | | 599. | | 1052. | | 1243. | |
| % Desulfurization | 47.5 | | 94.1 | | 96.5 | | 96.0 | | 98.6 | | 88.5 | | 61.9 | | 58.6 | | 84.1 | |
| % Demetalation | 96.3 | | 99.8 | | 98.6 | | 99.8 | | 98.6 | | 99.8 | | 98.8 | | 58.6 | | 99.9 | |
| % Nickel Removed | | 92.2 | | 99.3 | | 99.3 | | 99.3 | | 99.5 | | 99.4 | | 97.6 | | 98.6 | | 99.7 |
| % Vanadium Removed | | 98.1 | | 99.9 | | 98.5 | | 99.9 | | 98.5 | | 99.9 | | 99.0 | | 97.7 | | 100.0 |
| Delta API | 24.1 | | 29.2 | | 28.3 | | 31.3 | | 30.9 | | 27.2 | | 24.7 | | 21.2 | | 22.7 | |

TABLE XI (B)

| Catalyst Number | 1 | 2 | 3 | 4 | 5 | 6 | 8 | 9 | 10 |
|---|---|---|---|---|---|---|---|---|---|
| INSPECTIONS | | | | | | | | | |
| Oil Product ($H_2S$ Stripped) | | | | | | | | | |
| Gravity, API | 26.4 | 34.6 | 36.2 | 38.2 | 34.5 | 31.8 | 31.4 | 26.6 | 28.5 |
| Specific Gravity | .8961 | .8519 | .8438 | .8338 | .8524 | 8665 | .8686 | .8950 | .8844 |
| Sulfur, wt. % | 2.00 | 0.35 | 0.18 | 0.21 | <0.04 | 0.71 | 2.37 | 1.74 | 0.85 |
| Nitrogen, wt. % | 0.367 | 0.040 | 0.012 | 0.016 | 0.051 | 0.173 | 0.282 | 86.45 | 0.250 |
| Carbon, wt. % | 81.86 | 86.94 | 86.96 | 86.80 | 87.15 | 87.05 | 85.80 | 11.60 | 86.87 |
| Hydrogen, wt. % | 11.21 | 12.78 | 13.17 | 13.11 | 12.48 | 12.25 | 11.74 | 0.307 | 12.06 |
| Oxygen, wt. % | 0.43 | 0.05 | 0.03 | 0.02 | 0.08 | 0.1 | 0.02 | 0.20 | 0.15 |
| Water, wt. % | 0.11 | 0.01 | 0.02 | 0.01 | 0.02 | 0.05 | 0.07 | 0.06 | 0.02 |
| Carbon Residue, Conrad., wt. % (Rams) | 8.39 | 0.51 | 0.146 | 0.129 | 1.24 | 3.03 | 4.38 | 6.51 | 3.65 |
| Nickel, ppm | 1.8 | <0.5 | <0.5 | <0.5 | <0.5 | <0.5 | 1.7 | 2.4 | <0.5 |
| Molybdenum, ppm | — | <0.5 | 3.6 | <0.5 | 0.6 | <0.5 | <0.5 | 2.0 | <0.5 |
| Vanadium, ppm | 0.9 | <0.5 | 8.8 | <0.5 | <0.5 | <0.5 | 5.3 | 5.5 | <0.5 |
| Deasphalted Oil | | | | | | | | | |
| Gravity, API | 63.2 | 21.3 | 23.7 | 26.7 | 21.3 | 17.7 | −10.5 | 65.2 | 64.4 |
| Specific Gravity | .7268 | .9260 | .9120 | .8946 | .9260 | .9487 | 1.1691 | .7194 | .7223 |
| Sulfur, wt. % | 0.60 | 0.24 | 0.21 | 0.22 | 0.21 | 0.25 | 1.24 | 1.08 | 0.14 |
| Nitrogen, wt. % | 0.079 | 0.133 | 0.053 | 0.055 | 0.094 | 0.254 | 0.560 | 84.62 | 0.066 |
| Carbon, wt. % | 84.93 | 86.70 | 88.85 | 89.74 | 87.15 | 85.64 | 91.37 | 15.32 | 84.68 |
| Hydrogen, wt. % | 15.00 | 10.63 | 11.15 | 11.46 | 12.38 | 9.89 | 8.26 | 0.056 | 15.34 |
| Oxygen, wt. % | 0.18 | 0.24 | 0.11 | 0.05 | 0.21 | 0.36 | 0.99 | 0.13 | 0.05 |
| Carbon Residue, Rams, wt. % | 0.68 | 1.30 | 0.63 | 0.43 | 1.12 | 1.88 | 5.94 | 0.35 | 0.21 |
| Nickel, ppm | <0.1 | <3.0 | <2.7 | 2.7 | <2.6 | 2.5 | <6.2 | <0.1 | <0.5 |
| Molybdenum, ppm | — | <3.0 | <2.7 | 2.7 | <2.6 | 2.5 | <6.2 | 0.2 | <0.5 |
| Vanadium, ppm | 0.2 | <3.0 | <2.7 | 2.7 | <2.6 | 2.5 | <6.2 | 0.2 | <0.5 |
| Solids (Centrifuged) | | | | | | | | | |
| Sulfur, wt. % | 1.37 | 14.35 | 21.27 | 25.08 | 23.22 | 18.12 | 4.48 | 14.19 | 17.58 |
| Nitrogen, wt. % | 28.07 | 0.555 | 0.817 | 0.595 | 0.677 | 0.790 | 1.491 | 31.51 | 0.695 |
| Oxygen, wt. % | 2.43 | 10.1 | 12.6 | 4.8 | 3.6 | 5.4 | 5.3 | 1.89 | 3.3 |
| Carbon Residue, Rams, wt. % | 0.390 | 33.66 | 30.14 | 28.02 | 38.40 | 48.22 | 76.69 | 0.733 | 35.89 |
| Hydrogen, wt. % | 27.0 | 3.69 | 3.08 | 2.87 | 4.27 | 4.73 | 5.49 | 13.7 | 2.70 |
| Nickel, wt. % | 0.038% | 0.05% | 0.080% | 0.081% | 0.088% | 0.15% | 0.049% | 0.089% | (0.12%) |
| Molybdenum, wt. % | — | 9.7% | 18% | 29% | 23% | 19% | 0.036% | 7.4% | (22%) |
| Vanadium, wt. % | 46% | 21% | 15% | 10% | 5.0% | 2.7% | 8.5% | 30% | (0.54%) |

Figure 14:
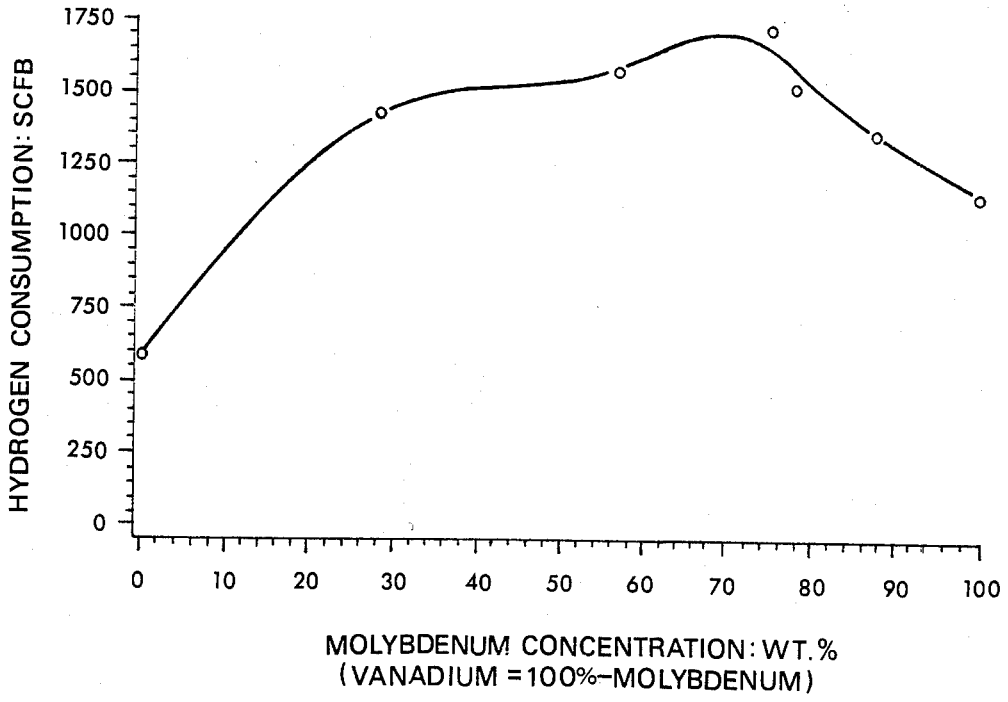
FIGS. 14, 15 and 16 show characteristics of a vanadium-containing catalyst.

The effect on the process of varying the vanadium/molybdenum ratio in the catalyst is obtained by comparing the performance of the molybdenum-vanadium catalysts prepared at constant hydrogen sulfide flow per weight of metals and at a constant ammonia to metals ratio. FIG. 14 shows catalyst activity in terms of total hydrogen consumption as a function of the catalyst molybdenum (as metal) concentration. In FIG. 14, the vanadium (as metal) concentration equals 100 minus the molybdenum concentration. FIG. 14 shows high catalyst activities at molybdenum concentrations above 15, 20, 25 or 30 weight percent, based upon total molybdenum plus vanadium content, i.e. at vanadium concentrations below even 70, 75, 80 or 85 weight percent.

Figure 15:
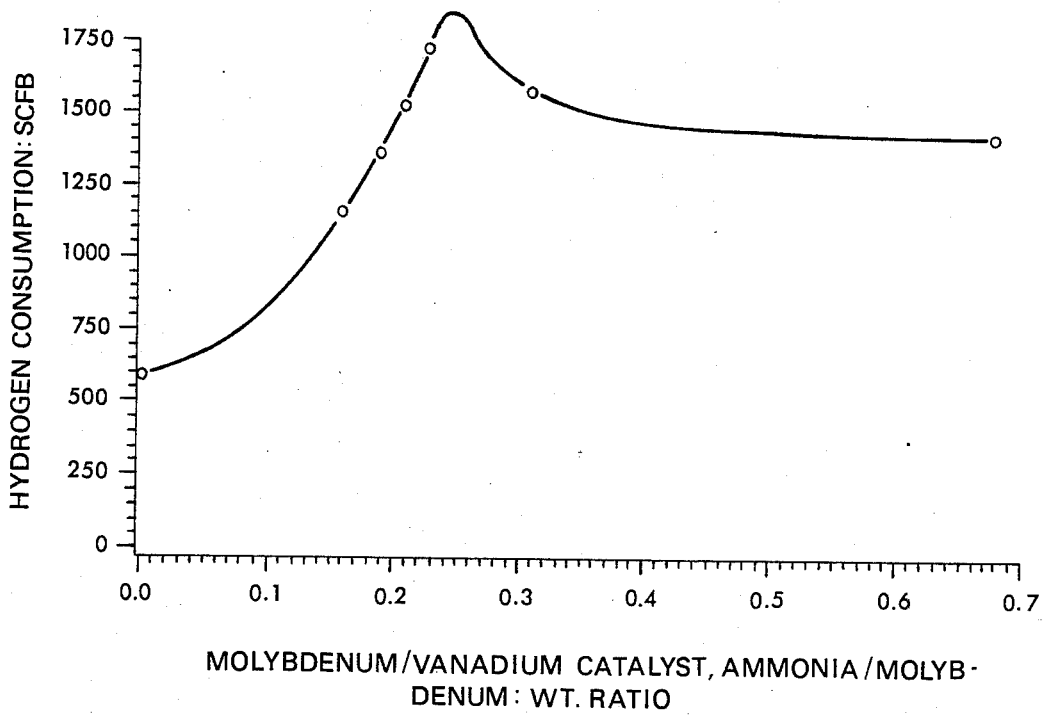

FIG. 15 compares the activity of the catalysts of Table VIII in terms of the amount of hydrogen consumed versus the $NH_3$/Mo weight ratio used in catalyst preparation at a constant $H_2S$ to total metals ratio. FIG. 15 shows an optimum at an ammonia to molybdenum weight ratio of about 0.24. Because this is essentially the same optimum ammonia to molybdenum ratio observed in earlier tests made with catalysts without vanadium, it appears that when using this ammonia/molybdenum ratio, the ammonia preferentially reacts with molybdenum in the presence of vanadium. This tends to indicate solubility differences between molybdenum and vanadium in aqueous ammonia solutions.

Table XII illustrates two tests made with molybdenum-free vanadium catalysts 1 and 8 of Table VIII in which one test was made with an elevated ammonia to vanadium ratio and the other was made at a lower ammonia to vanadium ratio. In the catalysts of the two tests the final S/V ratios were 0.87 and 0.05, respectively. When tested with Maya ATB under the conditions of the tests of Table X, the elevated sulfur vanadium catalyst produced more coke with less hydrogen consumed than the relatively unsulfided vanadium catalyst.

TABLE XII

MOLYBDENUM/VANADIUM CATALYST PREPARATIONS
VARIED $NH_3$/V RATIOS
T = 150° F.
Time = 2 Hours
$H_2S$ = 2 SCFH

| Catalyst Number | 1 | 8 |
|---|---|---|
| Catalyst Solution: gms | | |
| Molybdic Oxide | 0.0 | 0.0 |
| Vanadium Pentoxide | 96.0 | 36.0 |
| $NH_4OH$ (29.2% as $NH_3$) | 34.4 | 25.0 |
| Distilled Water | 289.1 | 124.0 |
| Total | 419.5 | 186.0 |
| Wt. % Mo in Solution | 0.0 | 0. |
| Wt. % V in Solution | 12.8 | 10. |
| Wt. % $NH_3$ in Solution | 2.4 | 4. |
| Wt. Ratio | | |
| $NH_3$/Mo | — | — |
| $NH_3$/V | .1875 | .370 |
| $NH_3$/Metals | .1875 | .370 |
| Charged to Autoclave: gm | 150.0 | 92. |
| S/V Final Catalyst | 0.05 | 0.87 |
| % Coke Yield | 2.8 | 10.3 |
| $H_2$ Consumption: SCFB | 594. | 272. |

Figure 16:
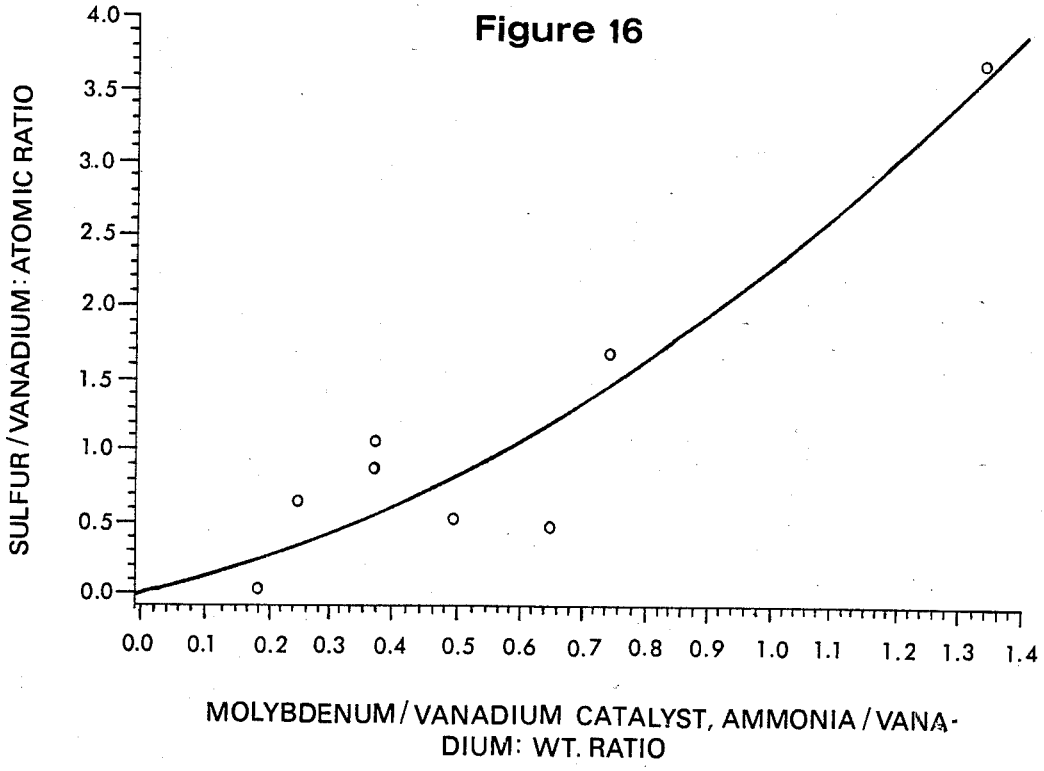

FIG. 16 presents a graph of the ammonia/vanadium weight ratio used in preparing various vanadium catalysts at a constant $H_2S$ to metals ratio versus the subsequent sulfur/vanadium ratio and shows that at elevated $NH_3$/V weight ratios a significant amount of vanadium sulfide can be produced. FIG. 16 indicates that in regenerating a recycled catalyst, formation of a significant amount of vanadium sulfide can be avoided by employing reduced levels of ammonia.

Figure 18:
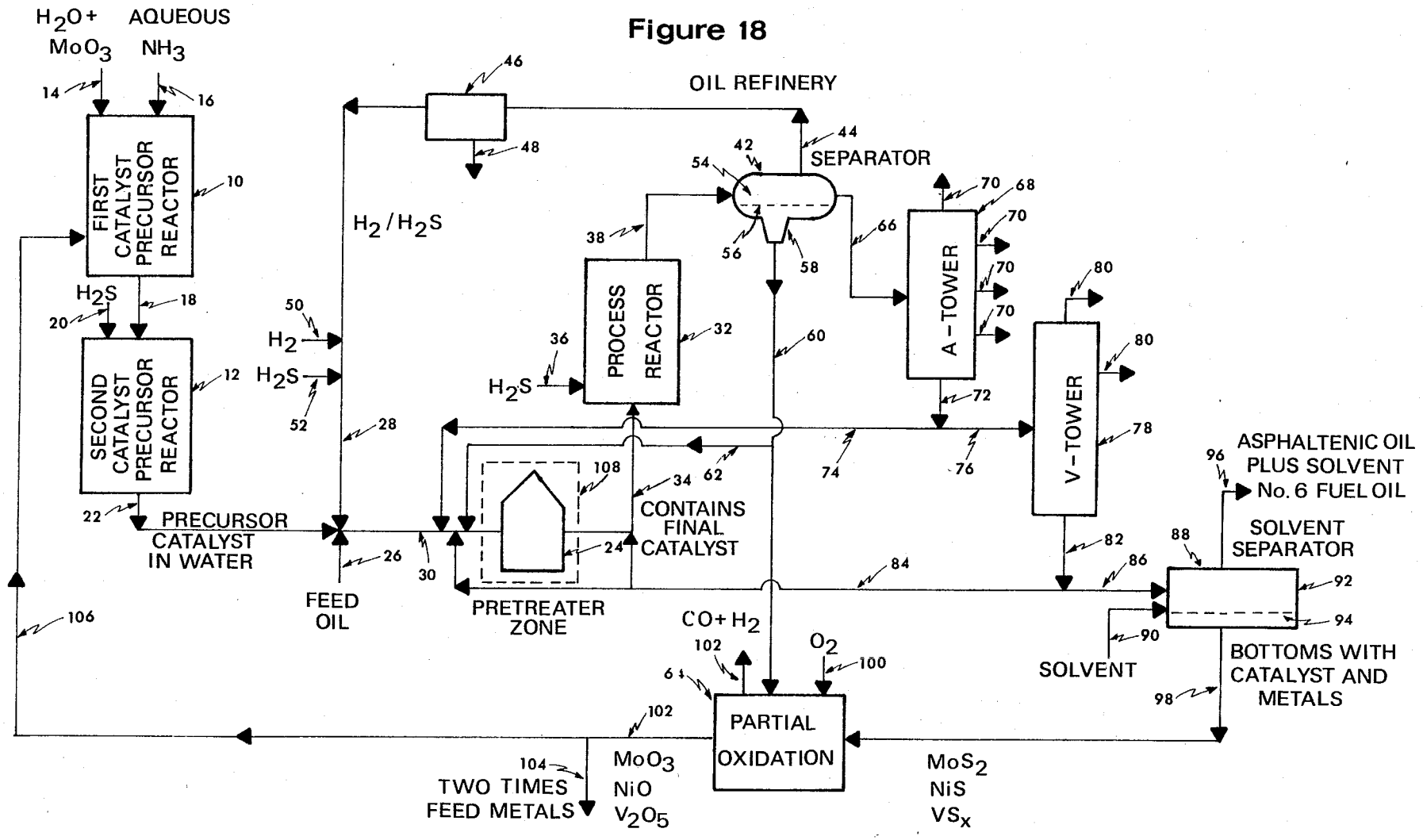
FIGS. 18 and 19 show line diagrams of the process.

FIG. 18 presents a diagram of a slurry catalyst hydroprocessing system including a catalyst precursor preparation zone, a hydrogen sulfide pretreater zone for high temperature-high pressure sulfiding, a hydrocarbon hydroprocessing zone and a catalyst recovery zone.

FIG. 18 shows a first catalyst precursor reactor 10 and a second catalyst precursor reactor 12. Solid molybdenum trioxide in water ($MoO_3$ is insoluble in water) in line 14 and aqueous ammonia (e.g. a 20 weight percent $NH_3$ solution in water) in line 16 are added to first precursor catalyst reactor 10. Preferably, 0.23 pounds of $NH_3$ (non-aqueous basis) per pound of Mo (calculated as metal) is added to reactor 10 to dissolve the molybdenum. Aqueous dissolved ammonium molybdate is formed in reactor 10 and passed to second catalyst precursor reactor 12 through line 18.

Gaseous hydrogen sulfide is added to reactor 12 through line 20 to react with the aqueous ammonium molybdate to form sulfided ammonium salts having the general formula $(NH_4)_xMoS_yO_z$. Preferably the amount of $H_2S$ added is 2.7 SCF per pound of Mo. About 88 weight percent of the sulfided compounds formed in reactor 12 are non-solids, being in the soluble or colloidal states (non-filterable). The remaining 12 percent of the sulfided compounds formed are in the solid state. These solid compounds are reddish to orange in color, are acetone soluble and are amorphous under X-ray diffraction. The system in reactor 12 is self-stabilizing so that if the solids are filtered out, replacement solids will settle out within an hour in the presence or absence of $H_2S$. The non-filterable soluble and colloidal state molecules are converted to filterable solid material by replacement of some O by S.

This mixture of sulfided compounds in water comprises the precursor catalyst. It passes through line 22 enroute to pretreater zone 24 where sulfiding reactions involving the precursor catalyst are completed at elevated temperature and pressure conditions. Before entering pretreater zone 24, the precursor catalyst in water in line 22 is first admixed with process feed oil entering through line 26, and with a gas containing a $H_2$-$H_2S$ mixture entering through line 28. These admixed components may, but not necessarily, comprise the entire feed components required by the process and they pass through line 30 to pretreater zone 24.

Pretreater zone 24 comprises multiple stages (see FIG. 19) which are overall operated at a temperature of 150° to 750° F., which temperature is below the temperature in process reactor 32. In pretreater zone 24, the catalyst precursor undergoes reaction to catalytically active $MoS_2$. Whatever the catalyst composition, the catalyst preparation reaction is substantially completed in pretreater zone 24. We have observed that the particle size of the catalyst solids can advantageously decline as the precursor catalyst passes through pretreater zone 24, provided that the catalyst precursor is prepared using the optimum $NH_3$/Mo ratio of this invention.

The catalyst leaving pretreater zone 24 through line 34 is the final catalyst and passes to process reactor 32 in the form of filterable slurry solids. The residence time of the slurry in process reactor 32 can be 2 hours, the temperature can be 820° F. and the total pressure can be 2500 psi. If desired, hydrogen sulfide can be added to reactor 32 through line 36 to maintain a hydrogren partial pressure of 1750 psi and a hydrogen sulfide partial pressure of 170 psi.

Effluent from reactor 32 flows through line 38 to high pressure separator 42. Process gases are withdrawn from separator 42 through overhead line 44 and pass through scrubber 46 for the removal through line 48 of impurities such as ammonia and light hydrocarbons, as well as a portion of the hydrogen sulfide. A purified mixture of hydrogen and hydrogen sulfide, or either alone, is recycled through line 28 for admixture with process feed oil. Any required make-up $H_2$ or $H_2S$ can be added through lines 50 and 52, respectively.

Sufficient residence time is allowed in separator 42 for an upper oil layer 54 to separate from a lower water vapor 56. The catalyst with metals removed from the feed oil tends to float in the water phase near the interface with the oil phase. The catalyst is removed from separator 42 by drawing off the water phase through downspout 58 and draw-off line 60. Some of this aqueous catalyst stream can be directly recycled through line 62 to the inlet of pretreater 24, if desired. If desired, some of this aqueous catalyst can be recycled between the plurality of stages comprising pretreater 24 by means not shown. The remainder is passed to partial oxidation zone 64, which is discussed later.

The upper oil layer 54 is drawn from separator 42 through line 66 and passed to atmospheric fractionation tower 68 from which various distillate product fractions are removed through a plurality of lines 70 and from which a residue fraction is removed through bottoms line 72. A portion of the residue fraction in line 72 may be recycled for further conversion, if desired, by passage through line 74 to the inlet of pretreater 24 or the inlet of reactor 32. Most or all of the A-tower residue is passed through line 76 to vacuum distillation tower 78, from which distillate product fractions are removed through lines 80, and a residue fraction is removed through bottoms line 82.

A portion of the V-tower bottoms fraction may be recycled to pretreater zone 24 through line 84, if desired, while most or all of the bottoms fraction passes through line 86 to solvent extractor 88. Any suitable solvent such as $C_3$, $C_4$ or naphtha, a light oil, diesel fuel or a heavy gas oil is passed through line 90 to solvent extractor 88 to extract oil from the catalyst and extracted metals which were not separated in separator 42. In extractor 88 an upper oil phase 92 is separated from a lower sludge phase 94. Oil phase 92 is removed through line 96 and comprises asphaltenic oil plus solvent and may constitute a low metals No. 6 fuel oil. Bottoms phase 94 is removed through line 98 and comprises catalyst and removed metals.

It is apparent that solvent extractor 92 could be replaced by a filter, if desired.

The catalyst in the line 98 sludge (or the precipitate from a filter, if used) is in a sulfided state and contains removed nickel and vanadium. The catalyst-containing sludge in line 98 is passed into partial oxidation zone 64 to which oxygen or air is introduced through line 100. Carbonaceous material in zone 64 can be gasified to syngas ($CO+H_2$) which is removed through line 102 for use as process fuel. The metal sulfides entering zone 64, which may include $MoS_2$, $NiS_y$ (y equals 1 to 2) and $VS_x$ (x equals 1 to 2.5), and $V_2S_5$ are oxidized to the corresponding metal oxides $MoO_3$, NiO and $V_2O_5$.

These metal oxides are removed from zone 64 through line 102. A portion of these metal oxides are removed from the process through line 104, while the remainder is passed to first catalyst precursor reactor 10 through line 106 for reaction with ammonia. When the weight of solids drawn off through line 104 is two times the amount of feed metal, a 50/50 blend of Mo and (V+Ni) can be established for circulation as an active catalyst within the system.

In a mode of operation not shown in FIG. 18, the $MoO_3$ can be separated from NiO and $V_2O_5$ by sublimation. In this mode, draw-off line 104 is not employed. Instead, a sublimation zone is inserted between lines 102 and 106 to sublime $MoO_3$ from the NiO and $V_2O_5$, and the purified $MoO_3$ without the other metal oxides is passed into line 106 for return to precursor reactor 10 for reaction with ammonia. Also, in a mode of operation not shown in FIG. 18, a portion of the feed oil can be injected between the stages directly to line 112 or line 116 of FIG. 19.

It was stated above that in precursor reactor 10, 0.23 pounds of $NH_3$ (non-aqueous basis) is added per pound of Mo. The Mo (calculated as metal) in this ratio includes Mo introduced both through lines 14 and line 106. This $NH_3$/Mo ratio should not be changed because of NiO and/or $V_2O_5$ entering precursor reactor 10 through line 106, or from any other source. Therefore, additional $NH_3$ is not added to compensate for accumulated metals, such as vanadium, thereby avoiding dissolving such metals.

Figure 19:
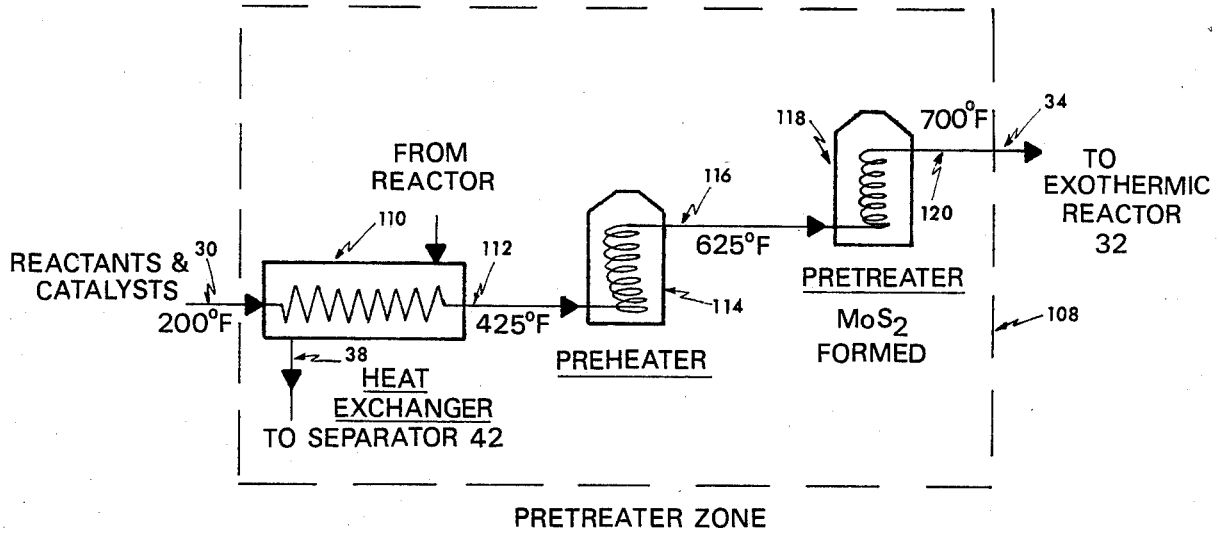

FIG. 19 presents a preferred mode of pretreater zone 108 of FIG. 18. Pretreater zone 108 comprises a plurality (e.g. two or three) of preheating zones, such as the three zones shown in FIG. 19. FIG. 19 shows reactants and catalyst in line 30 at a temperature of 200° F. entering the tube interior of a tube in shell heat exchanger 110, designated as the heat exchanger. The stream in line 30 includes aqueous precursor catalyst, heavy crude, refractory or residual feed oil, hydrogen and hydrogen sulfide and may include the catalyst-containing recycle streams in lines 74 and 84 of FIG. 18. Any high temperature stream can be charged to the shell of heat exchanger 110. For purposes of process heat economy, the hot process reactor effluent stream in line 38 can be charged through the shell of heat exchanger 110 in its passage to high pressure separator 42.

The reaction stream from heat exchanger 110 passes through line 112 at a temperature of about 425° F. to a preheater, which can be a furnace 114. The effluent from furnace 114 in line 116 is at a temperature of about 625° F. and is passed to a pretreater, which can be a furnace 118. The effluent from furnace 118 is at a temperature of about 700° F. to 810° F. and passes through line 120 to the exothermic process reactor 32, shown in FIG. 1.

Heat exchanger 110 and preheater 114 each retain the reactants for a relatively short residence time, while the residence time in pretreater 118 is longer. Zones 110, 114 and 118 serve to preheat the reaction stream to a sufficiently high temperature so that a net exothermic reaction can proceed without heat input in process reactor 32. Although the reactions occurring in process reactor 32 include both exothermic hydrogenation reactions and endothermic thermal cracking reactions, it is desired that in balance reactor 32 will be slightly exothermic. The threshold temperature for the stream entering reactor 32 through line 34 should be at about 700° F. to maintain reactor 32 in an exothermic mode for a heavy crude or residual feed oil.

It is noted that the 660° F. optimum preheat temperature is experienced in pretreater furnace 118. As noted above, it is critical that the precursor catalyst experience sulfiding at a temperature lower than the temperature of process reactor 32 and preferably in advance of and separate from process reactor 32.

The water in process reactor 32 is entirely in the vapor phase because the temperature in process reactor 32 is well above the critical temperature of water, which is 705° F. On the other hand, the temperature in much of pretreater zone 108 is below 705° F. so that the water therein is entirely or mostly in the liquid phase. When the system is at the optimum catalyst preheat temperature of 660° F., at least some water will be in the liquid phase. It is advantageous to employ mechanical mixing means in pretreater zone 108, particularly at the region of the 660° F. temperature, to emulsify the water and oil phases to obtain intimate contact between the water, oil, catalyst and hydrogen sulfide/hydrogen components during the final catalyst preparation stage.

The starting catalysts can be prepared from molybdenum as the sole metallic starting component. However, during processing the molybdenum can acquire both nickel and vanadium from a metal-containing feed oil. It is shown herein that nickel is a beneficial component and actually imparts a coke suppressing capacity to the catalyst. It is also shown herein that the catalyst has a high tolerance to vanadium and can tolerate without significant loss of catalyst activity an amount of vanadium equal to about 70 or 80 or even 85 percent of the total catalyst weight. The ability to tolerate a large amount of vanadium is a significant advantage since crude or residual oils generally have about a 5:1 weight ratio of vanadium to nickel. Used catalyst can be removed from the system and fresh catalyst added at rates such that the vanadium level on the circulating catalyst is equilibrated at about 70 weight percent, or at any other convenient level.

Various methods can be employed to recover a concentrated catalyst slurry stream for recycle. One method is the vacuum or deep atmospheric distillation of the hydroprocessing reactor effluent to produce a 800° F.+ product containing the slurry which can be recycled. Another method is by deasphalting with light hydrocarbons ($C_3$–$C_7$) or with a light naphtha product or with a diesel product obtained from the process. A third method is the use of high pressure hydroclones to obtain a concentrated slurry for recycle. The filtering and/or centrifuging of a portion (or all) of the atmospheric or vacuum reduced product will produce a cake or concentrate containing the catalyst which can be recycled or removed from the process.

Catalyst recovery advantageously can be partially obviated when the process is employed to upgrade a lubricating oil feedstock. A poor lubricating oil feedstock, such as a 650°–1000° F. fraction, is upgraded by processing with a molybdenum sulfide catalyst of this invention. As shown above, the average particle size of the slurry catalyst particles is advantageously reduced in the process reactor. Since the average particle size is very small, the particles can contribute to the lubricity of the lubricating oil product. Thereby, at least a portion of the lubricating oil boiling range fraction can be removed and recovered as an upgraded lubricating oil product for an automobile engine without removal of the catalyst slurry. The remaining portion of the product can be filtered or otherwise treated to separate the catalyst therefrom, and then recovered as a product, such as a fuel oil. Of course, the filtered upgraded oil within the lubricating oil boiling range will also constitute a good lubricating oil. Since lubricating oil and other distillate oil feedstocks are substantially metalsfree, when using a lubricating oil feedstock the filtered catalyst will not be contaminated with vanadium or nickel and can be directly recycled, if desired, without removal of metal contaminant therefrom.

Spent molybdenum catalyst containing nickel and vanadium from a process for hydroprocessing a metal-containing feed oil, no matter whether said spent catalyst is contained in the distillation residue, deasphalted pitch, or filter or centrifuge cake, can be recovered from the slurry product by any of the following methods.

(1) Partial oxidation or low temperature roasting of the highly concentrated metallic sulfides product produced by any of the above methods. It is of special interest that the molybdenum sulfide is easily oxidized due to the catalytic effect of vanadium (obtained from the oil). To illustrate the ease by which a solid vanadium-molybdenum product is oxidized, a high metals reactor product obtained from processing heavy residuals was exposed to low concentrations of air at a temperature of only 250° F. The results were as follows:

| | Before Oxidizing | After Oxidizing |
|---|---|---|
| Typical Composition: | | |
| Sulfur, wt % | 22.6 | 2.8 |
| Oxygen, wt % | 3.1 | 32.3 |
| Molybdenum, wt % | 31.2 | 54.6 |
| Nickel, wt % | 0.06 | 0.11 |
| Vanadium, wt % | 0.07 | 0.16 |
| Organic, wt % | 43.0 | 10.3 |
| (Carbon/Hydrogen) | | |
| Atomic Ratios: | | |
| Sulfur to Molybdenum | 2.17 | 0.16 |
| Oxygen to Molybdenum | 0.60 | 3.5 |

As can be seen, even at these extremely mild conditions almost 89 percent of the molybdenum was oxidized to $MoO_3$.

(2) The molybdenum oxide ($MoO_3$) can be separated from the nickel and the vanadium by direct subliming at elevated temperatures (1456° F.) with the molybdenum being removed overhead.

The molybdenum oxide ($MoO_3$) recovered by either of the above or any other method is then reacted with ammonium hydroxide and hydrogen sulfide, as described in the catalyst precursor preparation procedure, to yield the fine dispersions of molybdenum oxysulfides. If desired, some of the recycled catalyst can by-pass these recovery steps because it was shown above that the present process can tolerate substantial carry over of vanadium oxide in the circulating catalyst system without loss of activity.

We have found that a nickel catalyst, prepared from a nickel salt such as nitrate (as contrasted to nickel accumulation from a feed oil) can be used cooperatively with molybdenum as a catalyst for the slurry oil hydroprocessing of refractory oils. It has been found that the nickel passivates the coking activity of the molybdenum catalyst. Referring to Table XIII, test 2 illustrates the use of a nickel catalyst without molybdenum, and test 6 illustrates the use of a molybdenum catalyst without nickel. Test 6 shows a high hydrogen consumption and a concomitantly high aromatic saturation level, but also shows a relatively high coke yield. On the other hand, test 2 shows a lower hydrogen consumption and lower aromatic saturation level, but with no apparent coking.

TABLE XIII

| Screening Conditions: | | | | | | |
|---|---|---|---|---|---|---|
| Pressures: | | | | | | |
| Hydrogen, psi | ←2082→ | | | | | |
| Hydrogen Sulfide, psi | ← 182→ | | | | | |
| Water Vapor, psi | ← 392→ | | | | | |
| Temperature, °F. | ← 700→ | | | | | |
| Time at Temperature, hrs. | ← 6→ | | | | | |
| Cat.-to-Oil Ratio: | | | | | | |
| Nickel | — | .049 | .034 | .024 | .012 | — |
| Molybdenum | — | — | .011 | .024 | .036 | .048 |
| Total | — | .049 | .045 | .048 | .048 | .048 |
| Conversion: | | | | | | |
| Hydrogen Consumption: SCFB | 450. | 465. | 571. | 1334. | 825. | 1833. |
| Aromatic Saturation: % | 14.9 | 12.4 | 17.1 | 26.1 | 39.0 | 43.5 |
| Desulfurization: % | 26. | 2. | 0. | 77. | 61. | 65. |
| Coke Yield: % | 0.0 | 0.0 | 1.7 | 4.2 | 1.7 | 12.8 |
| Product Quality: | — | 57. | 22. | 50. | 23. | 60.0 |
| Liquid Product: | | | | | | |
| Product Delta, API: | 3.4 | 2.9 | 3.5 | 7.1 | 4.8 | 10.1 |
| Structural Group Analysis: | | | | | | |
| Aromatic Carbon, % CA | 49.5 | 51.0 | 47.9 | 43.0 | 35.5 | 32.9 |
| Naphthenic Carbon, % CA | 9.5 | 8.0 | 10.1 | 15.0 | 23.5 | 26.1 |
| Carbon not in Ring, % CA | 41.0 | 41.0 | 42.0 | 42.0 | 41.0 | 41.0 |
| Coke (Sludge) Product: | | | | | | |
| Coke H/C Ratio: | — | — | 0.73 | 0.90 | 0.92 | 1.06 |
| Metals Recovery: | — | 0. | 24. | 42. | 19. | 71.0 |
| Slurry Composition, %: | | | | | | |
| Sulfur | — | 32.0 | 41.2 | 40.0 | 35.7 | 39.4 |
| Nickel | — | 68.0 | 47.1 | 30.0 | 21.4 | — |
| Molybdenum | — | — | 11.8 | 30.0 | 42.6 | 60.6 |
| Catalyst Sulfur/Metals Ratio: | | | | | | |
| Atomic: | — | 0.86 | 1.39 | 1.52 | 1.38 | 1.94 |

Tests 3, 4 and 5 of Table XIII show a catalyst comprising a mixture of molybdenum and nickel. Although the hydrogen consumption and aromatic saturation levels are more moderate than in test 6, the reduction in coke yield is disproportionately greater. For example, test 4, whose catalyst employs a 50—50 blend of nickel and molybdenum, shows about a one-third reduction in hydrogenation activity as compared to test 6, but advantageously shows a two-thirds reduction in coke production. Therefore, the nickel appears to passivate the coking activity of the molybdenum catalyst. Surprisingly, the 50—50 blend catalyst of test 4 showed the greatest desulfurization activity of all the catalysts of Table XIII, but the molybdenum catalyst can contain up to 70, 80 or 85 weight percent of nickel as nickel.

We claim:

1. A hydroprocess comprising introducing feed oil, hydrogen, water, hydrogen sulfide and hydrogenation catalyst to a hydroprocessing zone, the weight ratio of water to oil being between 0.005 and 0.25, the partial pressure of hydrogen sulfide being between 20 and 400 psi, the hydrogen partial pressure being between 350 and 4500 psi, the temperature being between 650° and 1000° F., said water being at least partially in the vapor phase, said hydrogenation catalyst comprising sulfided molybdenum which is present in said hydroprocess in the molybdenum as metal to oil weight ratio of 0.0005 to 0.25 with said catalyst having been prepared by reacting aqueous ammonia and molybdenum oxide with a weight ratio of ammonia to molybdenum as metal of 0.1 to 0.6 to form aqueous ammonium molybdate, reacting said aqueous ammonium molybdate with hydrogen sulfide to form a precursor slurry, mixing said precursor slurry with feed oil, hydrogen and hydrogen sulfide and heating said mixture at a pressure between 500 and 5000 psi so that it is within the temperature range of 150° to 350° F. for a duration of 0.05 to 0.5 hours, further heating said mixture so that it is within the temperature range of 351° to 750° F. for a time duration of 0.05 to 2 hours, and said hydroprocess to include recycling to said hydroprocessing zone a hydrogen-hydrogen sulfide stream separated from the hydroprocessing zone effluent wherein the partial pressure of hydrogen sulfide is at least 20 psi so that the circulation of hydrogen sulfide is greater than 5 SCF per pound of molybdenum as metal and the hydrogen circulation rate is between 500 to 10,000 SCFB.

2. The process of claim 1 wherein said second heating occurs within the temperature range of 351° to 500° F. for a duration of 0.05 to 0.5 hours to avoid excessive coking, and within the temperature range 501° to 750° F. for a duration of 0.05 to 2 hours to avoid excessive coking.

3. The process of claim 1 wherein said feed oil contains vanadium, recovering oil product from said hydroprocessing zone, separating a fraction of said product comprising vanadium-containing molybdenum catalyst, oxidizing and recycling at least a portion of said vanadium-containing molybdenum catalyst to said aqueous ammonia-molybdenum oxide reaction step, and reacting ammonia with molybdenum in said ammonia-molybdenum oxide reaction step in a weight ratio of 0.1 to 0.6 of ammonia to total molybdenum as metal in said step.

4. The process of claim 3 wherein the catalyst is recovered from the hydroprocessing zone effluent and recycled to said hydroprocessing zone and the circulating catalyst contains vanadium in an amount up to 85 weight percent of vanadium as metal.

5. The process of claim 3 wherein the catalyst is recovered from the hydroprocessing zone effluent and recycled to said hydroprocessing zone and the circulating catalyst contains nickel in an amount up to 85 weight percent of nickel as metal.

6. The process of claim 3 wherein the catalyst is recovered from the hydroprocessing zone effluent and recycled to said hydroprocessing zone and the circulating catalyst contains vanadium in an amount up to 85 weight percent of vanadium as metal and nickel in an amount up to 85 weight percent of nickel as metal.

7. The process of claim 1 wherein the water in said catalyst preparation steps is present in the liquid phase.

8. The process of claim 1 wherein the catalyst particles in the hydroprocessing zone have an average diameter smaller than the average diameter of the particles in said precursor slurry.

9. The process of claim 1 wherein said feed oil is crude oil.

10. The process of claim 1 wherein said feed oil is heavy crude oil.

11. The process of claim 1 wherein said feed oil is residual oil.

12. The process of claim 1 wherein said feed oil is heavy distillate.

13. The process of claim 1 wherein said feed oil is FCC decanted oil.

14. The process of claim 1 wherein said feed oil is lubricating oil.

15. The process of claim 1 wherein said feed oil is shale oil.

16. The process of claim 1 wherein said feed oil is oil from tar sand.

17. The process of claim 1 wherein said feed oil is coal liquid.

18. The process of claim 1 wherein said feed oil contains vanadium.

19. The process of claim 1 wherein said feed oil contains nickel.

20. The process of claim 1 wherein said feed oil contains nickel and vanadium.

21. The process of claim 1 wherein said catalyst is catalytically active crystallite sulfide of molybdenum having a S/Mo atomic ratio of about two.

22. The process of claim 1 including recovering hydrocarbon product from said hydroprocessing zone, and separating a catalyst-containing lubricating oil fraction from said product.

23. The process of claim 1 wherein said feed oil is a distillate oil and including recovering hydrocarbon product from said hydroprocessing zone, separating a catalyst-containing residual fraction of said product, and recycling a portion of said residual fraction within said process.

24. The process of claim 3 wherein said recycling step results in equilibrating a molybdenum-vanadium proportion of up to 85 weight percent vanadium in the process.

25. The process of claim 3 wherein said recycling results in equilibrating about a 50—50 molybdenum-vanadium weight ratio in the process.

26. The process of claim 1 wherein said precursor slurry is prepared at a temperature in the range 80° to 450° F., a pressure in the range atmospheric to 400 psi, and with at least 0.5 SCF $H_2S$ per pound of Mo.

27. The process of claim 1 wherein in said heating steps the hydrogen pressure is 350 to 4500 psi, the hydrogen sulfide pressure is 20 to 400 psi, the hydrogen to oil ratio is 500 to 10,000 SCF/B and the hydrogen sulfide to Mo ratio is 5 SCF/pound or greater.

28. The process of claim 1 wherein at least 0.5 SCF of $H_2S$ per pound of Mo is used in preparing the precursor slurry.

29. The process of claim 1 wherein between 1 and 16 SCF of $H_2S$ per pound of Mo is used in preparing the precursor slurry.

30. The process of claim 1 wherein a portion of the feed oil is introduced between the heating steps.

31. The process of claim 1 wherein the water is in the liquid phase during said heating steps and is entirely in the vapor phase during said hydroprocess.

32. The process of claim 1 wherein the Mo to oil weight ratio in the hydroprocessing zone is between 0.003 and 0.05.

33. The process of claim 1 wherein in the hydroprocessing zone the $H_2S$ circulation rate is greater than 5 SCF $H_2S$/#Mo.

34. The process of claim 1 wherein a catalyst-containing product fraction from the hydroprocessing zone is recycled directly to either of said heating steps.

35. The process of claim 1 wherein said weight ratio of ammonia to molybdenum as metal is 0.18 to 0.44.

36. The process of claim 1 wherein said weight ratio of ammonia to molybdenum as metal is 0.19 to 0.27.

37. The process of claim 1 wherein said precursor slurry comprises insoluble non-crystalline ammonium molybdenum oxysulfide in equilibrium with ammonium heptamolybdate in solution.

* * * * *